US009439488B2

(12) United States Patent
Davis

(10) Patent No.: US 9,439,488 B2
(45) Date of Patent: Sep. 13, 2016

(54) JEWELRY STORAGE SYSTEM

(71) Applicant: Shirley Mae Davis, Dayton, OH (US)

(72) Inventor: Shirley Mae Davis, Dayton, OH (US)

( * ) Notice: Subject to any disclaimer, the term of this patent is extended or adjusted under 35 U.S.C. 154(b) by 0 days.

(21) Appl. No.: 14/672,266

(22) Filed: Mar. 30, 2015

(65) Prior Publication Data

US 2015/0201724 A1 Jul. 23, 2015

Related U.S. Application Data

(63) Continuation-in-part of application No. 13/998,060, filed on Sep. 28, 2013, and a continuation-in-part of application No. 29/442,757, filed on May 7, 2013, now Pat. No. Des. 728,936.

(60) Provisional application No. 61/744,700, filed on Oct. 2, 2012.

(51) Int. Cl.

| | |
|---|---|
| ***A45C 11/16*** | (2006.01) |
| ***A45C 13/30*** | (2006.01) |
| ***A45C 13/10*** | (2006.01) |
| ***A45C 13/00*** | (2006.01) |
| ***A45C 13/02*** | (2006.01) |

(52) U.S. Cl.

CPC ..... *A45C 11/16* (2013.01); *A45C 13/002* (2013.01); *A45C 13/02* (2013.01); *A45C 13/30* (2013.01); *A45C 2013/026* (2013.01); *A45C 2200/05* (2013.01); *A45C 2200/15* (2013.01)

(58) Field of Classification Search

CPC .... A45C 13/00; A45C 13/002; A45C 13/10; A45C 13/30; A45C 13/02; A45C 13/42; A45C 11/16; A45C 2200/15; A45C 2013/026; A45C 15/00; A45C 2013/303; A45C 2013/306; A45C 11/04

See application file for complete search history.

(56) References Cited

U.S. PATENT DOCUMENTS

| | | | | | |
|---|---|---|---|---|---|
| 4,735,246 | A * | 4/1988 | Niehaus | A45C 7/0095 | 206/479 |
| 4,760,920 | A * | 8/1988 | Thomsen | A45C 11/16 | 150/131 |
| 5,121,833 | A * | 6/1992 | Lindsay | A45C 7/0095 | 206/18 |
| 5,246,103 | A * | 9/1993 | Hicks | A45C 11/16 | 206/495 |
| 5,490,619 | A * | 2/1996 | Boyar | A45F 3/02 | 150/103 |
| 5,617,948 | A * | 4/1997 | Rainey | A45C 11/16 | 206/5 |
| 6,634,041 | B2 * | 10/2003 | Higashi | A45C 3/10 | 383/4 |
| 8,312,990 | B2 * | 11/2012 | Gaspari | A45C 11/26 | 206/566 |
| 8,590,698 | B1 * | 11/2013 | Osborne | A45C 11/04 | 206/38 |
| 8,627,950 | B2 * | 1/2014 | Bland | A45C 7/0077 | 206/495 |
| 2007/0151871 | A1 * | 7/2007 | Brawley | A45C 11/24 | 206/37 |
| 2007/0158380 | A1 * | 7/2007 | Calkin | A41D 13/0012 | 224/675 |
| 2015/0335140 | A1 * | 11/2015 | Cole | A45F 5/02 | 24/3.7 |

* cited by examiner

*Primary Examiner* — Andrew Perreault

(74) *Attorney, Agent, or Firm* — Dinsmore & Shohl LLP

(57) ABSTRACT

A jewelry storage system having a protective jewelry sleeve and a display board is disclosed. The display board has a rigid insert disposed inside a sleeve cover with at least one securing band wrapped fully around the sleeve cover and at least one clasp loop forming at least two open slots with a center bridge formed therebetween. The protective jewelry sleeve forming a sleeve with a single open end sized to dispose the display board therein. The protective jewelry sleeve having a closure cuff configured to flip over the open end of the protective jewelry sleeve and cover the open end of the protective jewelry sleeve disposed proximal the open end and an identification marker cuff configured to hold an identification marker with indicia of the contents of the jewelry storage system disposed distal the open end.

20 Claims, 15 Drawing Sheets

JEWELRY STORAGE SYSTEM

CROSS-REFERENCE TO RELATED APPLICATIONS

This application is a continuation-in-part of U.S. patent application Ser. No. 13/998,060 filed Sep. 28, 2013, entitled SINGLE-PIECE CUFFED JEWELRY SLEEVE AND DISPLAY BOARD SET: DISPLAY-TRAVEL-STORAGE ALL-IN-ONE PROTECTIVE SET, which is a continuation-in-part of U.S. Design patent application Ser. No. 29/442,757, filed May 7, 2013, and which claims the benefit of U.S. Provisional Application No. 61/744,700, filed Oct. 2, 2012. The contents of all of which applications are hereby incorporated by reference in their entirety.

BACKGROUND OF THE INVENTION

Jewelry is one of the most coveted investments and fashion accessories and thus it is desirable to store and display jewelry in a secure manner.

U.S. Pat. No. 4,735,246 and U.S. Pat. No. 5,246,103 are for storage, display and travel of multiple pieces of exposed jewelry with fixed and/or limiting dimensions. The fixed dimensions are not conducive for consumer customization to meet unique requirements for style, size and classification of jewelry storage. Both U.S. Pat. No. 4,735,246 and U.S. Pat. No. 5,246,103 are limited to a visually obstructing display layout for the stored jewelry as the jewelry hangs in a side-by-side arrangement. Additionally, exposing decorative jewelry surfaces directly to metal or other hard surfaces such as hooks of jewelry creates potential abrasion damage from rubbing or other movement. Previous storage solutions constantly expose and subject all stored jewelry to potential damage from adjacent hanging jewelry when handling the jewelry in search of specific selections. Both U.S. Pat. No. 4,735,246 and U.S. Pat. No. 5,246,103 also subject every piece of jewelry to abrasive accumulation of dust and allow sterling silver jewelry to tarnishing from constant air exposure each time the protective covering is removed to access one or more pieces of the stored jewelry. Stored jewelry not immediately needed is subjected to unnecessary handling and dishevelment without purpose with loose jewelry storage in fixed containers. Both U.S. Pat. No. 4,735,246 and U.S. Pat. No. 5,246,103 target home consumers of Fashion Jewelry. Multi-pieces of jewelry stored closely, touching or with a high likelihood of touching is not ideal or generally acceptable for storing fine or sentimental jewelry.

Transporting pre-filled multiple jewelry storage and display mobile containers as disclosed in U.S. Pat. No. 4,735,246 and U.S. Pat. No. 5,246,103 has utility only when travel requires all the stored jewelry. Otherwise, additional efforts are required to select and remove jewelry not needed for travel, creating the need for temporary storage and associated reorganizing, reattaching and/or replacing the jewelry temporarily removed from the mobile storage container when travel is completed.

Accordingly, in view of the above deficiencies in storage and display of jewelry, there is a need for improved storage and display of jewelry.

BRIEF SUMMARY OF THE INVENTION

It is against the above background that embodiments of the present disclosure generally relate to protective packaging for individual pieces of jewelry stored alone or within a group. This disclosure is directed to embodiments of a jewelry storage system having a protective jewelry sleeve and a display board which packages jewelry for display, storage and travel with all functions interchangeable. The jewelry storage system of this disclosure is for all styles, sizes and classifications of jewelry for the home and retail consumers. Each individual pieces of jewelry, within the storage of multiple pieces of jewelry, is securely packed for unexposed protection with ease of identification without visibility. The jewelry storage system of this disclosure also keeps each single-piece of jewelry protected and secured in storage with simultaneous and interchangeable functions of display-readiness for personal fashion coordination or retail sales and packed-readiness for personal travel or mobile retail sales travel.

According to a first aspect of the present disclosure, a jewelry storage system having a protective jewelry sleeve and a display board is provided. The display board includes a rigid insert disposed inside a sleeve cover. The sleeve cover includes at least one securing band wrapped fully around the sleeve cover and at least one clasp loop forming at least two open slots with a center bridge formed therebetween. The rigid insert is formed from a rigid panel sized to fit snuggly into the sleeve cover and provide rigidity to the display board. Additionally, the protective jewelry sleeve forms a sleeve with a single open end which is sized to dispose the display board therein. The protective jewelry sleeve has a closure cuff disposed proximal the open end and an identification marker cuff disposed distal the open end. The closure cuff forms an invertible cuff configured to flip over the open end of the protective jewelry sleeve and cover the open end of the protective jewelry sleeve. Further, the identification marker cuff forms a cuffed pocket configured to hold an identification marker with indicia of the contents of the jewelry storage system.

According to another aspect of the present disclosure, a jewelry storage system having a protective jewelry sleeve and a display board is provided. The display board is formed from a rigid insert disposed inside a sleeve cover. The sleeve cover includes at least three securing bands wrapped fully around the sleeve cover and affixed to the sleeve cover at only one end. Each of the securing bands include a reversible closure mechanism to reversibly affix the opposite end of the at least three securing bands to the sleeve cover. The sleeve cover additionally includes at least one clasp loop forming at least two open slots with a center bridge formed therebetween. The sleeve cover further includes at least one hanging loop affixed to one of the securing bands, the hanging loop comprising a loop with open ends configured to allow passage of jewelry through the open ends and retention therein. Additionally, the sleeve cover includes a piercing surface formed from a mesh disposed adjacent the at least one clasp loop, the piercing surface sized and configured for attachment of earrings thereto by passage of the posts or hooks of said earrings through the holes in the piercing surface. The rigid insert is formed from a rigid panel sized to fit snuggly into the sleeve cover and provide rigidity to the display board. Further, the protective jewelry sleeve forms a sleeve with a single open end which is sized to dispose the display board therein. The protective jewelry sleeve includes a protective jewelry sleeve shell forming an exterior surface of the protective jewelry sleeve and a protective jewelry sleeve lining forming an interior of the protective jewelry sleeve. Additionally, the protective jewelry sleeve includes closure cuff disposed proximal the open end and an identification marker cuff disposed distal the open end. The closure cuff forms an invertible cuff configured to flip over the open end of the protective jewelry sleeve and cover the open end of the protective jewelry sleeve and the identification marker cuff forms a cuffed pocket configured to hold an identification marker with indicia of the contents of the jewelry storage system. Further, the protective jewelry sleeve includes a hanging handle disposed proximal the single open end which is revealed when the closure cuff is flipped over the open end of the protective jewelry sleeve to cover the open end of the protective jewelry sleeve. Finally, the display board also includes padding disposed between the rigid insert and the sleeve cover and the protective jewelry sleeve includes padding disposed between the protective jewelry sleeve shell and the protective jewelry sleeve lining.

According to yet another aspect of the present disclosure, a jewelry storage system having a protective jewelry sleeve and a display board is provided. The display board includes a rigid insert disposed inside a sleeve cover. The sleeve cover has at least three securing bands wrapped fully around the sleeve cover and affixed to the sleeve cover at only one end. The securing bands have a reversible closure mechanism selected from a hook and loop fastener, a snap, a clip, a ribbon configured for tying, and a hook and eye closure to reversibly affix the opposite end of the at least three securing bands to the sleeve cover. The sleeve cover also includes at least one clasp loop forming at least two open slots with a center bridge formed therebetween. Additionally the sleeve cover includes at least one hanging loop affixed to one of the securing bands, the hanging loop formed from a loop with open ends configured to allow passage of jewelry through the open ends and retention therein. The sleeve cover further has a storage pocket disposed distal the at least one clasp loop. Further, the sleeve cover includes piercing surface formed from a mesh disposed adjacent the at least one clasp loop, the piercing surface sized and configured for attachment of earrings thereto by passage of the posts or hooks of said earrings through the holes in the piercing surface. Finally, the sleeve cover has a reversible closure configured to allow the rigid insert to be reversibly removed from the sleeve cover and reinserted therein. The rigid insert is formed from a rigid panel sized to fit snuggly into the sleeve cover and provide rigidity to the display board. Further, the protective jewelry sleeve forms a sleeve with a single open end which is sized to dispose the display board therein. The protective jewelry sleeve includes a protective jewelry sleeve shell forming an exterior surface of the protective jewelry sleeve and a protective jewelry sleeve lining forming an interior of the protective jewelry sleeve. The protective jewelry sleeve also includes a closure cuff disposed proximal the open end and an identification marker cuff disposed distal the open end. The closure cuff forms an invertible cuff configured to flip over the open end of the protective jewelry sleeve and cover the open end of the protective jewelry sleeve and the identification marker cuff forms a cuffed pocket configured to hold an identification marker with indicia of the contents of the jewelry storage system. Additionally, the protective jewelry sleeve has a hanging handle disposed proximal the single open end which is revealed when the closure cuff is flipped over the open end of the protective jewelry sleeve to cover the open end of the protective jewelry sleeve. The protective jewelry sleeve also includes at least one hanging loop affixed to an interior of the protective jewelry sleeve adjacent the single open end, the hanging loop comprising a loop with open ends configured to allow passage of jewelry through the open ends and retention therein. Further, the protective jewelry sleeve has a piercing surface formed from a mesh disposed adjacent the hanging loop, the piercing surface sized and configured for attachment of earrings thereto by passage of the posts or hooks of said earrings through the holes in the piercing surface. Further, the display board includes padding disposed between the rigid insert and the sleeve cover and the protective jewelry sleeve includes padding disposed between the protective jewelry sleeve shell and the protective jewelry sleeve lining on both a front and a back side of the protective jewelry sleeve. Finally, the sleeve cover extends beyond the rigid insert to form a cushioned region configured to allow perforation therethrough for securing of jewelry comprising a sharp stud or pin thereto.

In accordance with embodiments, the jewelry storage system is an ultimate protective jewelry storage set for protecting individual pieces of jewelry within grouped storage of multiple pieces of jewelry and/or other objects. The set consist of a padded and rigid jewelry display board and a protective jewelry sleeve designed to revolutionize various existing jewelry storage cabinets, containers, furniture, hanging mechanism and/or other creative storage solutions by storing each piece of jewelry individually and protected for display and/or travel at all times.

In accordance with embodiments, the jewelry storage system stores single pieces of jewelry of any size and style by using the display board's appropriate and permanently attached optional features such as a clasp loop with a center bridge for separating the jewelry sides, a jewelry piercing surface for attaching jewelry with posts and/or pins, two open slots for hanging earrings with ear wire, and a number of equally spaced securing bands or ribbon ties to secure the jewelry from movement in storage. The jewelry is secured to the display board with its style and length fully displayed and inserted into the protective jewelry sleeve, concealing and storing the jewelry for quick access and instant display viewing at all times.

In accordance with embodiments, the protective jewelry sleeve has protective padding and two attached exterior cuffs. The top upper edge cuff (the closure cuff) flips over the sleeve opening securely enclosing the display board inside the protective jewelry sleeve. The lower front edge attached cuff (identification marker cuff) displays a visible identification card or photo of the enclosed jewelry for easy identification without visibility. The protective jewelry sleeve and display board together create a sandwich effect of padded protection of each piece of jewelry in storage.

The jewelry sleeve and display board of the jewelry storage system of the present disclosure can revolutionize existing jewelry storage containers and/or solutions, updating each to become more efficient rather than obsolete. The features are interchangeable in eliminating the need to fold or bunch over-sized jewelry to fit limited-sized single-piece jewelry boxes and eliminates damage from tangling and/or bunching of loose jewelry dropped or loosely placed in inefficient and/or obsolete single-piece jewelry storage containers. Embodiments of the jewelry sleeve and display board effectively eliminates the repeated clutter, dishevel and/or damaging environments resulting from grouping multiple pieces of exposed jewelry side-by-side or layered in storage containers, furniture, shelving units, from hanging mechanisms and/or any combination of fixed jewelry storage and display products for storing multiple pieces of exposed jewelry together. 'Cluttered-visions' of exposed jewelry stored together are eliminated with the jewelry sleeve and display board and effortless selection of specific jewelry from within a grouped storage is without hindrance.

The jewelry storage system of this disclosure eliminates the need to handle or displace stored jewelry not needed or selected for travel or any other use. With the jewelry storage system having the protective jewelry sleeve and display board, each specific piece of jewelry needed from storage is easily identifiable, selected, and simply returned to permanent storage in its individual protective jewelry sleeve and display board set after each use and/or completed travel without direct handling, displacing or reorganizing any of the stored jewelry not needed for use. This invention is designed with complete simplicity for the modern consumer. All parts are permanently attached allowing the jewelry storage system to function without any additional effort to attach or detach parts to perform the travel, storage or display functions.

In accordance with embodiments, the jewelry storage system of this disclosure displays jewelry from two non-damaging fabric or other soft material open slots formed from the clasp loop with a center bridge separating the sides of the jewelry, displaying the jewelry in a manner to identify the jewelry style and shape.

The jewelry storage system's all-inclusive design and functions for individual pieces of jewelry is perfect for all jewelry classifications: Antique, Fashion, Fine and Sentimental Jewelry. The jewelry storage system target markets include the home consumer, mobile jewelry salesperson, retailers of fashion and fine jewelry.

These and other features and advantages of the invention will be more fully understood from the following description of various embodiments of the invention taken together with the accompanying drawings.

BRIEF DESCRIPTION OF THE SEVERAL VIEWS OF THE PHOTOGRAPHS

The following detailed description of the various embodiments of the present invention can be best understood when read in conjunction with the following drawings, where like structure is indicated with like reference numerals in which.

DETAILED DESCRIPTION OF THE INVENTION

Figures 1A, 1B:
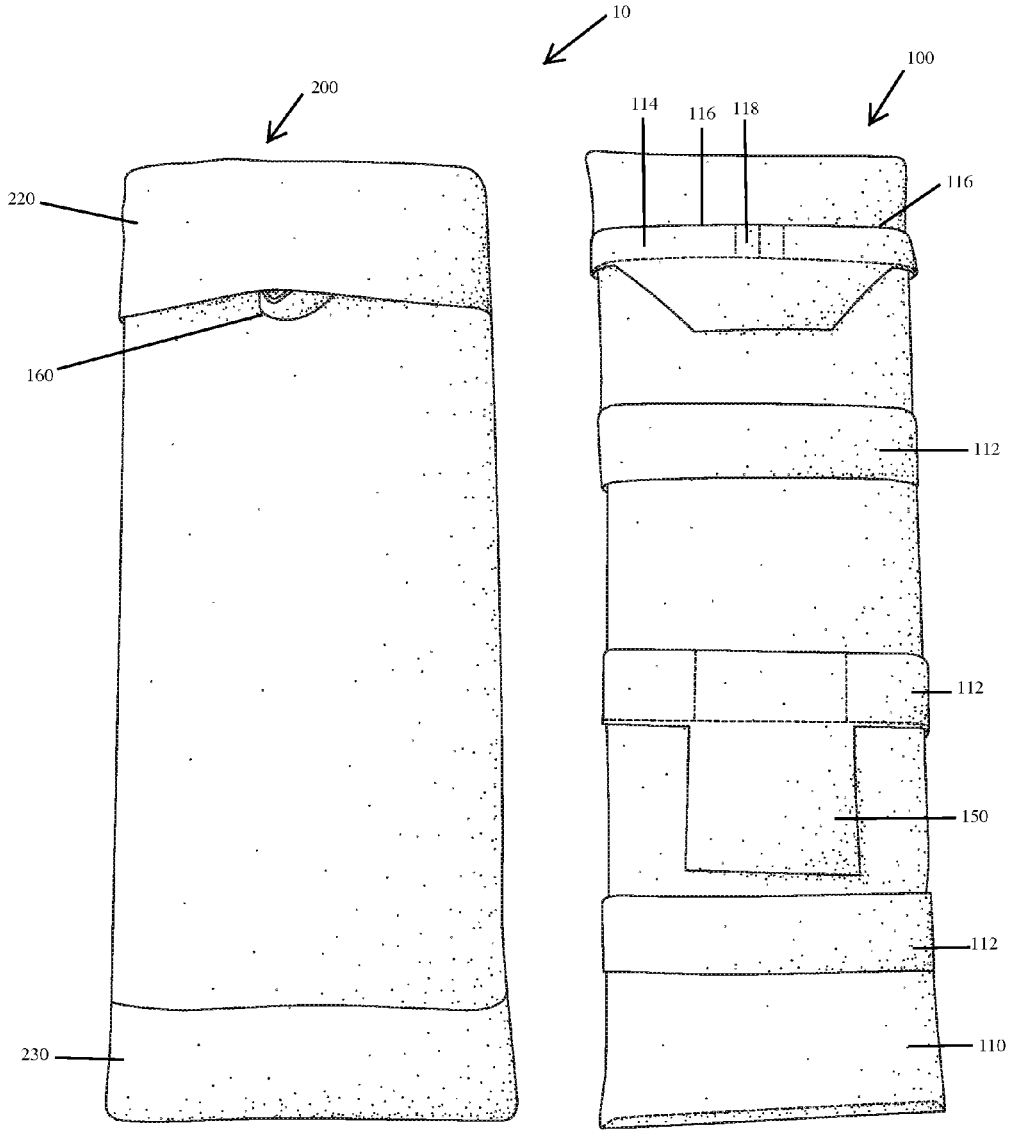
FIG. 1A is a front elevational view of a protective jewelry sleeve according to embodiments of the present disclosure.
FIG. 1B is a front elevational view of a display board according to embodiments of the present disclosure.
Figure 2A:
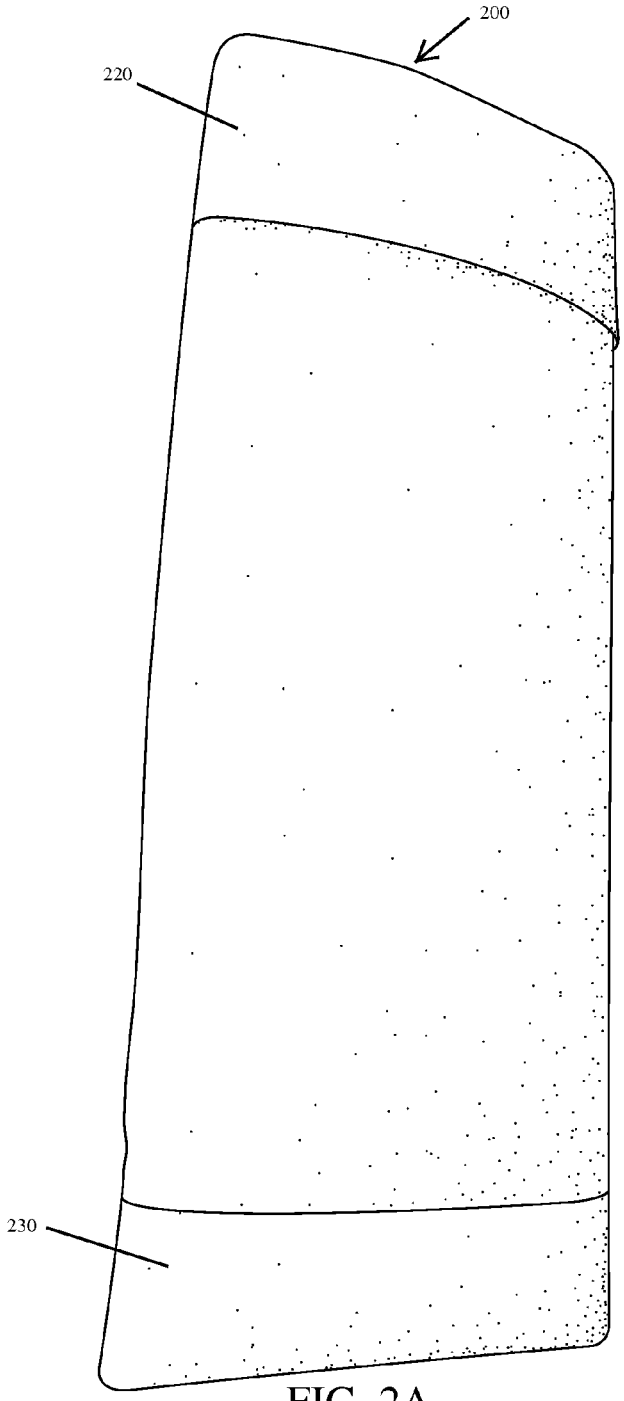
FIG. 2A is a front perspective view of a protective jewelry sleeve according to embodiments of the present disclosure.
Figure 2B:
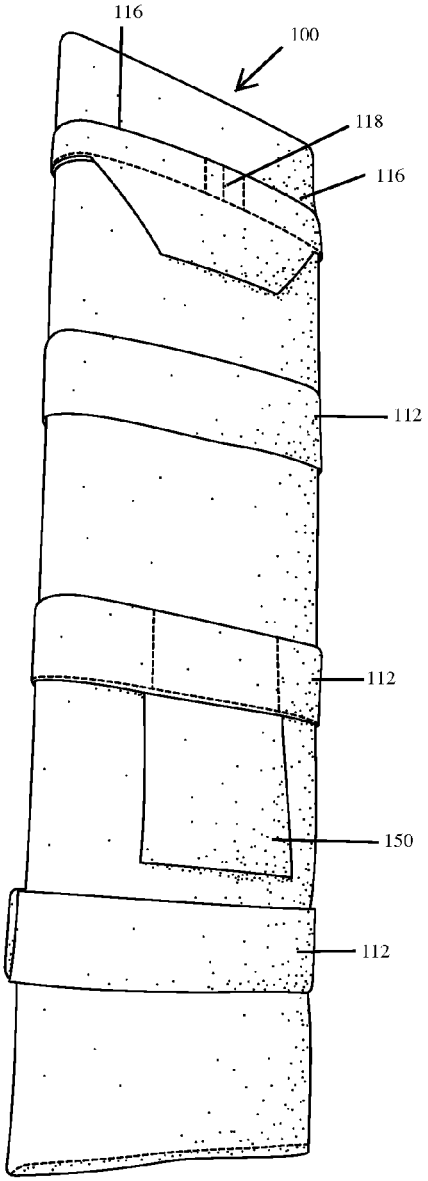
FIG. 2B is a front perspective view of a display board according to embodiments of the present disclosure.

With reference to FIGS. 1A, 1B, 2A, 2B, 3A, 3B, 10A, and 10B, this disclosure of a jewelry storage system 10 focuses on protecting individual pieces of jewelry stored within a grouping of multiple pieces of jewelry from dust, abrasion, tangling or any other damage from objects within storage. The jewelry storage system 10 includes a protective jewelry sleeve 200 and a display board 100. The display board 100 includes a rigid insert 130 disposed inside a sleeve cover 110. The sleeve cover has at least one securing band 112 wrapped fully around the sleeve cover 110 and at least one clasp loop 114 forming at least two open slots 116 with a center bridge 118 formed therebetween. The rigid insert 130 comprises a rigid panel sized to fit snuggly into the sleeve cover 110 and provide rigidity to the display board 100. The protective jewelry sleeve 200 forms a sleeve with a single open end 210. Additionally, the protective jewelry sleeve 200 is sized to allow the display board 100 to slide into an interior cavity through the single open end 210. The protective jewelry sleeve 200 also has a closure cuff 220 disposed proximal the open end 210 and an identification marker cuff 230 disposed distal the open end 210. The closure cuff 220 forms an invertible cuff configured to flip over the open end 210 of the protective jewelry sleeve 200 and cover the open end 210 of the protective jewelry sleeve 200. The identification marker cuff 230 formed from a cuffed pocket configured to hold an identification marker with indicia of the contents of the jewelry storage system 10.

Preventable damage intervention when jewelry is not in use is a two-fold process in accordance with this disclosure. First, the display board 100 secures a single piece of jewelry for viewing with the securing bands 112 in a display position. Second, the display board 100 is enclosed in the protective jewelry sleeve 200 which has the closure cuff 220 that flips over the sleeve opening 210 to provide a secure closure. Additionally, the identification marker cuff 230 at the lower front edge of the protective jewelry sleeve 200 holds an identification marker with indicia of the contents of the jewelry storage system 10. For example, the identification marker may be an Identification Card or photo of the stored jewelry which enable identification of the jewelry within the jewelry storage system 10 without direct visualization and without disheveling the storage of other stored items.

The display board 100 and protective jewelry sleeve 200 may be manufactured in a range of ready-made sizes and materials to include special order size and material options to allow consumers to customize their unique storage needs. These customizable options revolutionize consumers existing storage solutions and/or create and organize new and more effective solutions for the modern consumers and travelers.

With reference to FIG. 11 through FIG. 15, each piece of jewelry is secured to an appropriately sized display board 100 by inserting each end of a necklace or bracelet through the open slots 116 of the clasp loops 114 and closing the jewelry clasp in the same manner as worn around the neck or wrist. The center bridge 118 between the open slots 116 of the clasp loop 114 simulates the neck and/or wrist by separating the jewelry sides and enabling the jewelry to hang in an abbreviated display of its style for viewing and storage. Additionally, earrings may be securely hung from the open slots 116 of the clasp loop 114 and/or secured to the cushioned region 190 above the clasp loop 114.

For protection in storage, in at least one embodiment, the jewelry is secured to the display board 100. The securing band 112 is affixed to the sleeve cover 110 at only one end and the securing bands 112 wrap around the jewelry and the display board 100 and fasten securely in place onto the display board 100 with a reversible closure mechanism 120, for examples a hook and loop fastener. Additional, not limiting, reversible closure mechanisms 120 include hook and eye closures, snaps, clips, and ribbons for tying. In further embodiments the securing band 112 is affixed at both ends and includes securing bands 112 of elastic to allow reversible stretching of the at least one securing band 112 for passage of jewelry therethrough. The variety of options for the reversible closure mechanism 120 used for the display board 100 securing bands 112 provides customizable preferences for individual consumers unique motor skills and/or visual preferences for the style of jewelry being attached with the securing bands 112. Regardless of preference each style of securing band 112 provides equivalent security and protection. Additionally, metal or hard materials of the reversible closure mechanism 120 are attached to the back of the display board 100 and away from any stored jewelry to eliminate possible harmful contact with the jewelry.

The number of securing bands 112 affixed to an individual display board 100 may vary. For example, in multiple embodiments a single securing band 112 is provided. In further embodiments two securing bands 112 are provided. In yet further embodiments three or more securing bands 112 are provided. The number of securing bands may vary depending on the length of the display board 100 as well as the desired level of jewelry retention. In a preferred embodiment, three securing bands 112 are provided to form a balance between retention of jewelry placed on the display board 100 and allowing continued visualization of the piece of jewelry.

In embodiments, the display board 100 is padded with padding 180 and has specific protective attached features configured to secure specific types of jewelry to the display board 100 for display and/or storage. These specific attaching features are creatively and aesthetically stitched to the display board 100 to allow the economical and interchangeable use of the jewelry storage system 10 for all types of jewelry. The attaching features are discussed throughout this disclosure. One will appreciate that the variety of attaching features allow coordinating sets of a necklace, bracelet, ring, earrings, broaches, additional jewelry types, and subsets thereof, to be safely stored together in a single jewelry storage system 10.

The width of the display board 100 is based on the style of jewelry to be stored thereon. For example, earrings, broaches, pins, rings, and/or single strand jewelry may use a three-inch or wider display board 100 and bulky stones or multiple strand jewelry may use a four-and-one-half inch or wider display board 100 to provide additional storage space. The display board 100 length is based on the jewelry's actual length except for bracelets and necklaces for which the display board 100 length should be at least half the length of the necklace or bracelet. For example, a 4 inch long pair of earrings and an 8 inch long bracelet both use a 4 inch or longer display board 100 and a 24 inch long necklace would use a 12 inch long or longer display board 100. The sleeve cover 110 is constructed approximately 1½ to 2½ inches wider and approximately one inch longer than the rigid insert 130 to allow the rigid insert 130 to snuggly slide into the sleeve cover 110. Additionally, the extended length of the sleeve cover 110, in selected embodiments, allows the sleeve cover 110 to extend beyond the rigid insert 130 to form the cushioned region 190 configured to allow perforation therethrough and securement of jewelry having a sharp stud or pin thereto.

In embodiments, the sleeve cover 110 of the display board 100 also includes at least one hanging loop 150 affixed to one of the securing bands 112. The hanging loop 150 is formed from a loop with open ends which is configured to allow passage of jewelry through the open ends. For example a bracelet with a clasp may be passed through the hanging loop 150 and then once the clasp is engaged the hanging loop 150 retains the bracelet. In further embodiments, the hanging loop 150 is configured to reversibly open to allow passage of the open hanging loop through a piece of jewelry and subsequently be closed to retain the piece of jewelry therein. For example, a reversible closure mechanism such as a hook and loop fastener may secure the hanging loop 150 in a closed position forming a complete loop while allowing the hanging loop 150 to be temporarily opened to pass through a bangle style bracelet.

In embodiments, the rigid insert 130 is a canvas, foam, mat or wood-product board inserted into the sleeve cover 110. The rigid insert 130 provides stiffness and rigidity to the display board to allow ease of insertion into the protective jewelry sleeve 200 as well as rigidity to the entire jewelry storage system 10 during storage and/or transport.

In embodiments the rigid insert 130 and/or the protective jewelry sleeve 200 and/or the sleeve cover 110 may have anti-tarnish properties. As the protective jewelry sleeve 200 and the sleeve cover 110 are in direct contact with metals which tarnish, the presence of an anti-tarnish agent in the material of manufacture may provide an added benefit during storage. In further embodiments the rigid insert 130 and/or the protective jewelry sleeve 200 and/or the sleeve cover 110 may have additional additives to provide secondary benefits. For example, the rigid insert 130 may comprise cedar to provide a repellant action to bugs and moths in the closet or drawer where the jewelry storage system 10 is stored.

Figure 13:
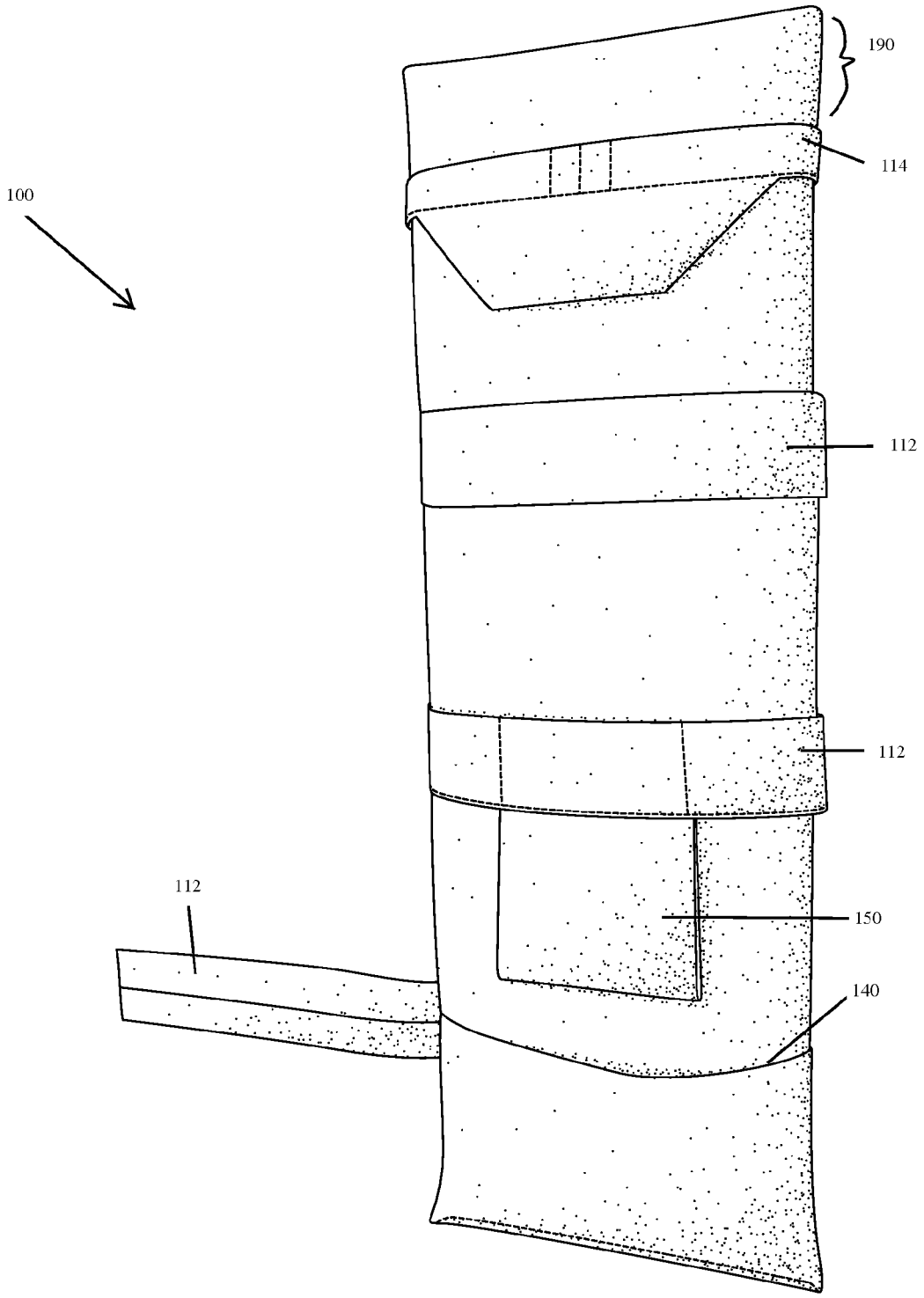
FIG. 13 is a front perspective view of FIG. 10A with a single securing band partially unfurled according to embodiments of the present disclosure.
Figure 14:
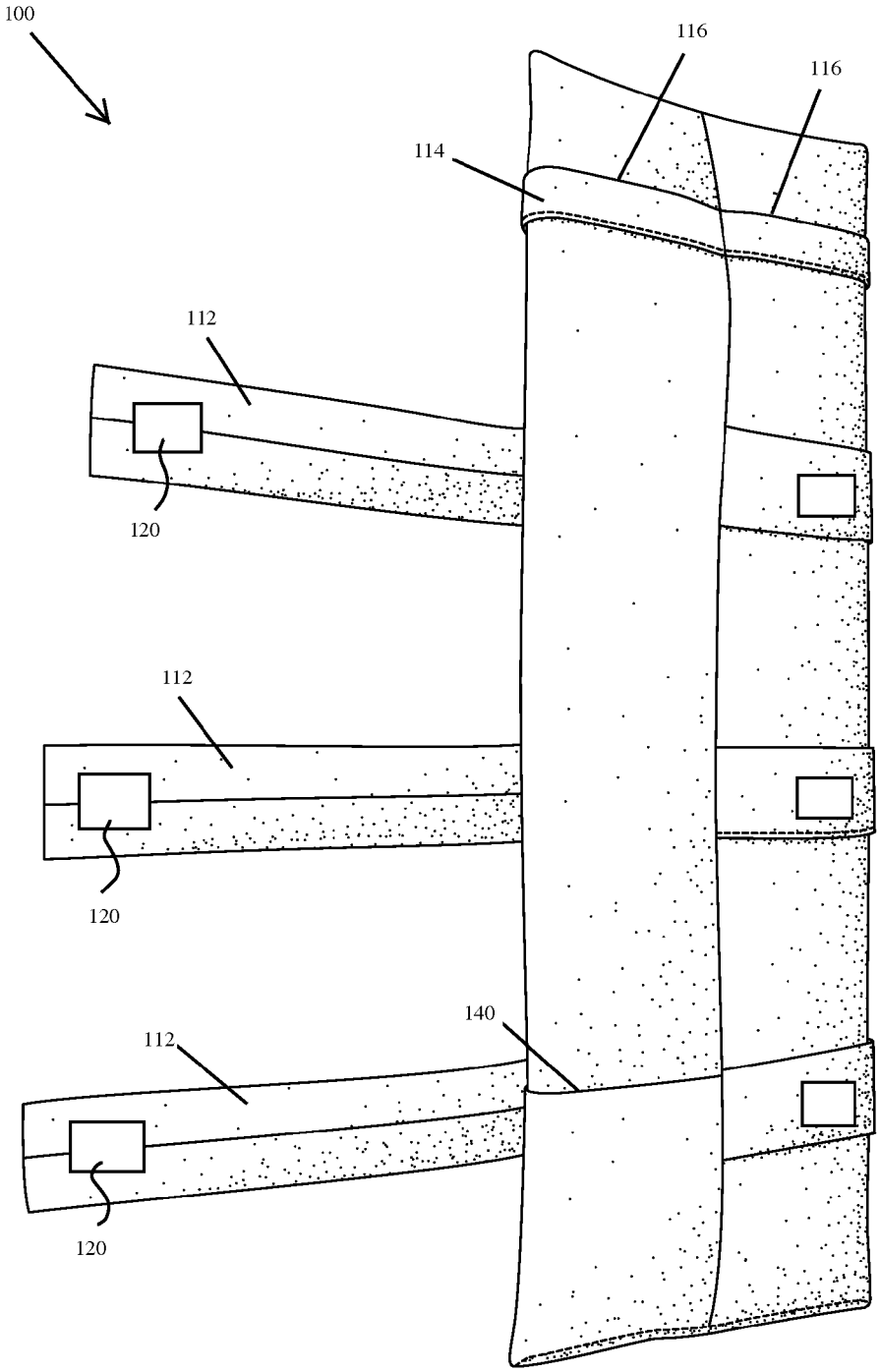
FIG. 14 is a rear perspective view of FIG. 10A with securing bands partially unfurled according to embodiments of the present disclosure.
Figure 15:
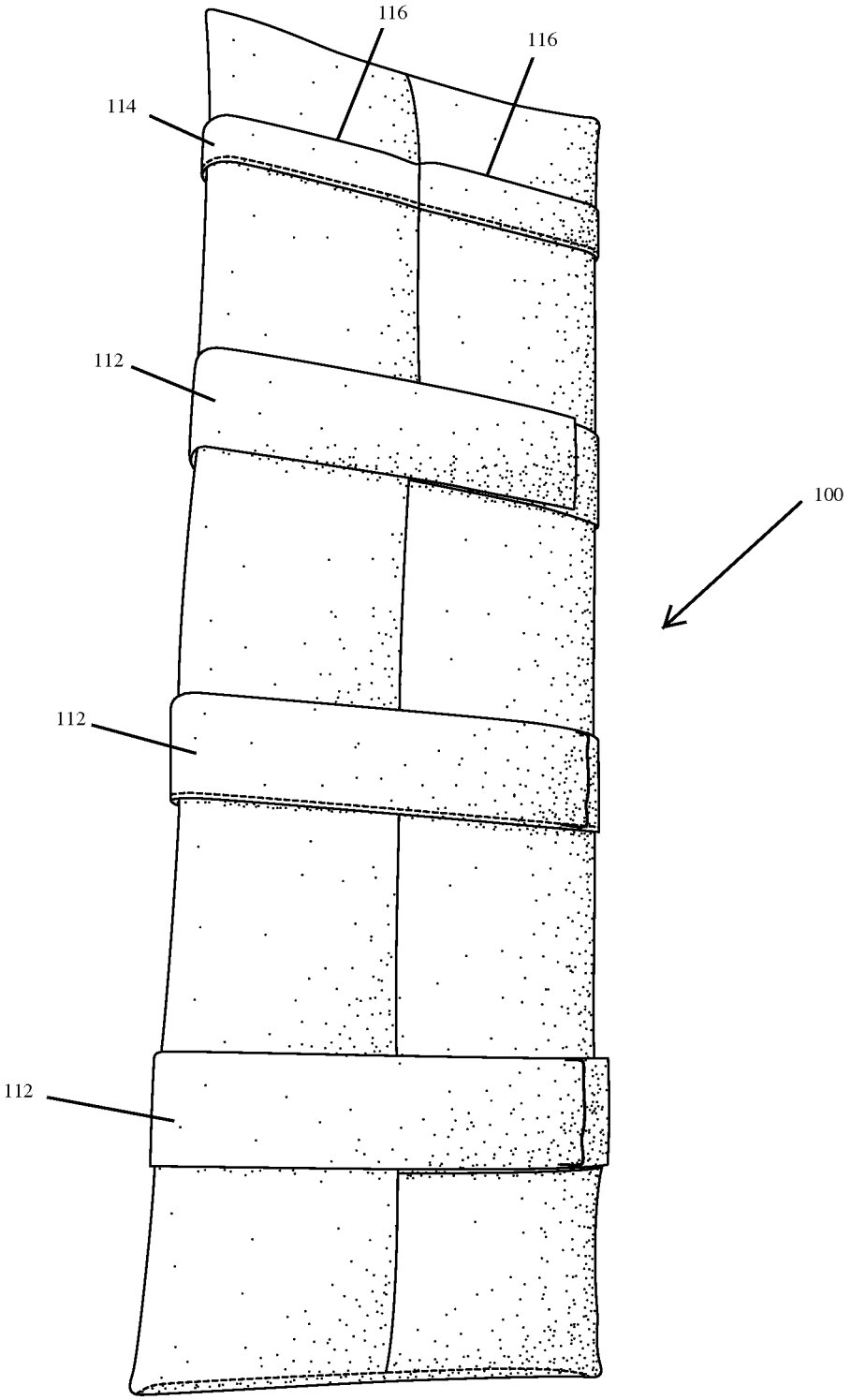
FIG. 15 is a rear perspective view of FIG. 10A with securing bands secured according to embodiments of the present disclosure.

With reference to FIG. 13, the sleeve cover 110 and padding 180 may extend beyond the rigid insert 130 to form a cushioned region 190 comprising a padded top edge above the rigid insert 130. The cushioned region 190 may be used as a surface to attach jewelry and by piercing the studs of earrings or a broach pin for example through the cushioned region 190.

Figure 11:
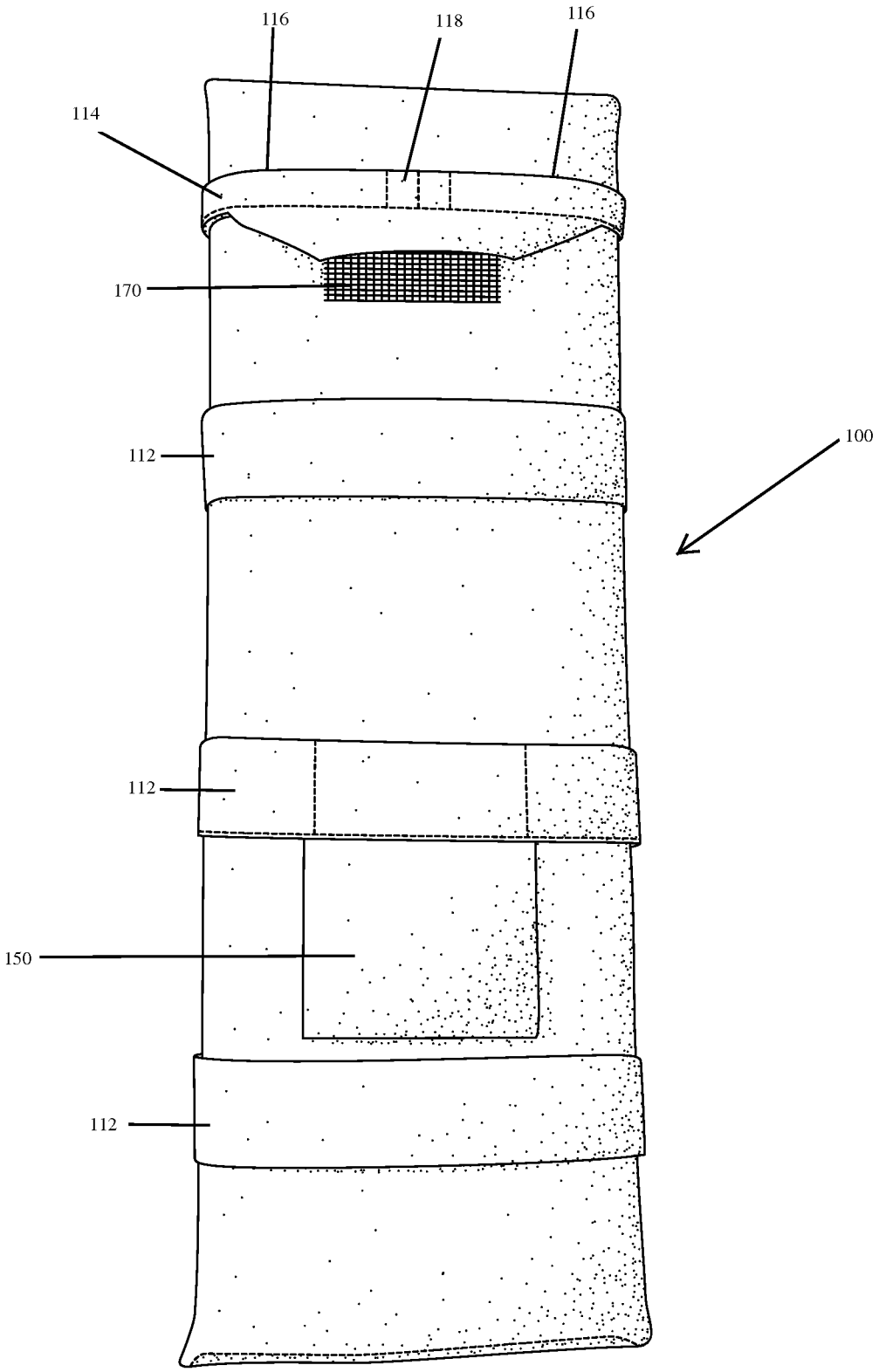
FIG. 11 is a front elevational view of FIG. 10A according to embodiments of the present disclosure.
Figure 12:
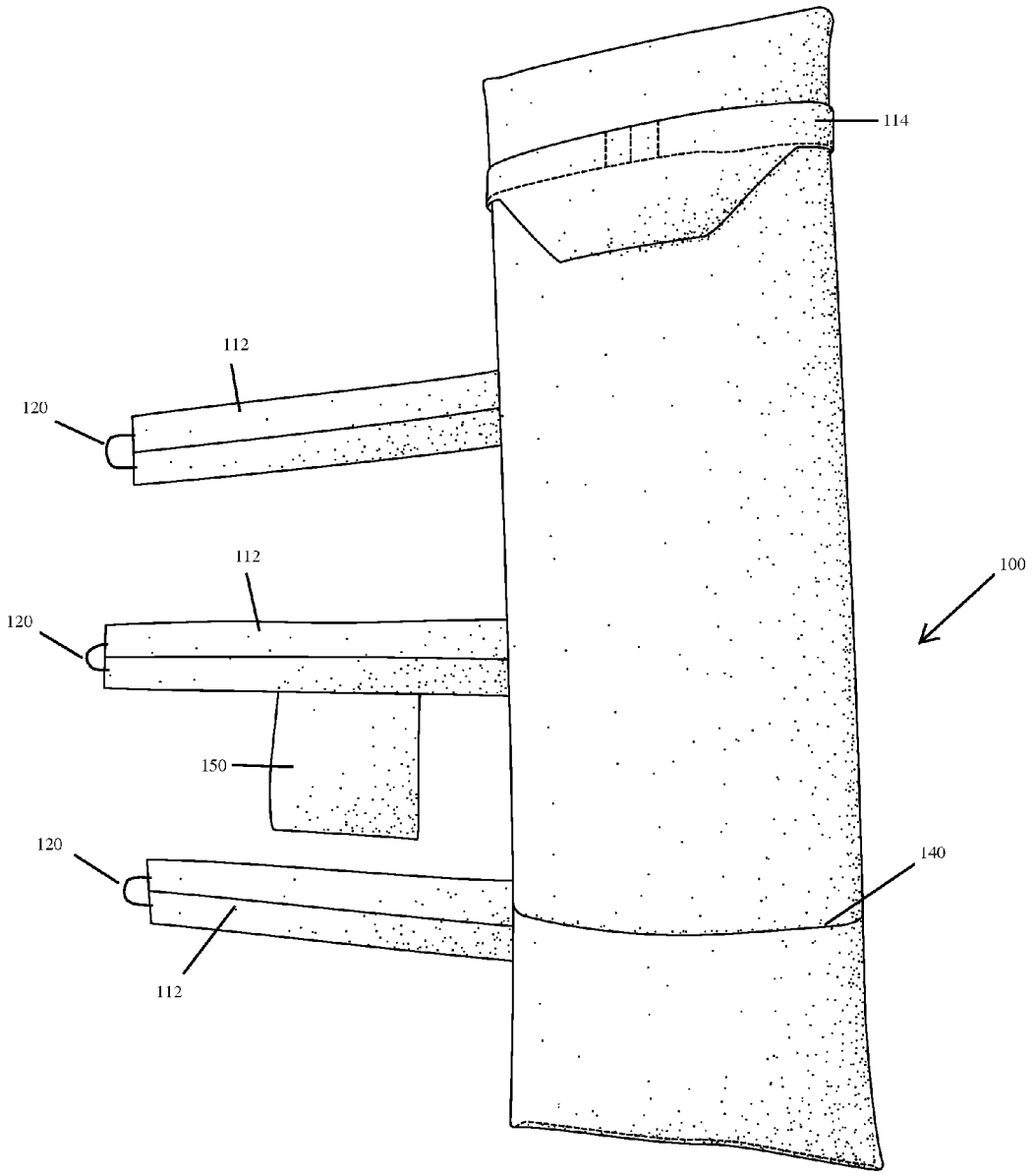
FIG. 12 is a front perspective view of FIG. 10A with securing bands partially unfurled according to embodiments of the present disclosure.

With reference to FIG. 11, in multiple embodiments, a piercing surface 170 of netting, lace, mesh, or any coordinating material can be attached to the display board 100. Specifically, the piercing surface 170 may be affixed to the sleeve cover 110 front side, adjacent the clasp loop 114, for example. One having skill in the art would appreciate that the piercing surface 170 may be located in other regions of the display board 100 as well. In specific embodiments, the piercing surface 170 may comprise a mesh with holes sized and configured for attachment of earrings thereto by passage of the posts or hooks of the earrings through the holes in the piercing surface 170.

In various embodiments, the jewelry storage system 10 has a package label and product label (not shown) which indicate product size and recommended range of jewelry sizes and styles to use for the full protective benefits of the jewelry storage system 10. The display board 100 with the secured and appropriate size jewelry is inserted into the protective jewelry sleeve 200 with the jewelry facing up to complete the twofold packaging sequence. Placement of the display board 100 into the protective jewelry sleeve 200 provides the twofold storage and protection of each individual piece of jewelry.

With reference to FIG. 4 through FIG. 9, in embodiments, the protective jewelry sleeve 200 has a front/top-side layer of padding 180, the closure cuff 220, the identification marker cuff 230, and a carrying or hanging handle 160. The closure cuff 220 flips over the sleeve opening 210 of the protective jewelry sleeve 200 to securely close the protective jewelry sleeve 200, concealing the display board 100 and jewelry from dust exposure. Additionally, closure of the closure cuff 220 acts as a prevention measure to keep the display board 100 safely locked inside the protective jewelry sleeve 200 while maintaining a combined sandwich effect of padded protection for the attached jewelry as the jewelry is stored between the protective jewelry sleeve 200 and any protective padding on the display board 100.

In embodiments, the protective jewelry sleeve 200 has a concealed hanging handle 160 for hand carrying or hanging the jewelry storage system 10. The hanging handle 160 is revealed for use when the closure cuff 220 is flipped over to close the sleeve opening 210 of the protective jewelry sleeve 200. The hanging handle 160 enables the jewelry storage system 10 to be hung from a variety of hanging mechanism while organizing, protecting and eliminating layers of exposed jewelry placed atop of each other in a cluttered and damaging environment. The hanging handle 160 may be used to hang the jewelry storage system 10 in identifiable and protective layers of unexposed single pieces of jewelry. Because of the various choices of the ready-made and special-order manufacturing, the jewelry storage system 10 can be color coordinated as a room décor accessory when the jewelry storage system 10 is visibly hanging from a wall/door, placed on shelving or placed in open-style creative and/or decorative storage containers.

The identification marker cuff 230 is disposed on the front-side of the protective jewelry sleeve 200 and is configured to hold an identification card, photo, or other identification marker with indicia of the contents of the jewelry storage system 10 for easy identification of the contents of the jewelry storage system without having to remove the jewelry. Eliminating the need for jewelry removal effectively eliminates constant dishevelment, clutter and reorganizing as with a mass storage of exposed jewelry.

The jewelry storage system 10 may be manufactured in a variety of lengths to accommodate a variety of jewelry lengths as well as allow identification markers in the identification marker cuff 230 to be display as a plurality of display board 100 and protective jewelry sleeve 200 length combinations are stacked. Specifically, stacking or hanging the jewelry storage system 10 where the protective jewelry sleeve 200 (and display board 100 therein) are provided in two or more inches intervals allow the Identification marker to always be visible for each piece of stored jewelry at an instant glance. For example, a series of jewelry storage systems 10 with an approximately 4½ inch width and approximately 4, 6, 12, and 16 inch lengths may be stacked with the top edges and closure cuffs 220 even allowing the identification marker cuff 230 of each jewelry storage system 10 to remain visible. Additionally, stacking jewelry storage systems 10 with all the same length does not hinder identification as the identification marker cuff 230 is attached at the bottom of the protective jewelry sleeve 200 and slightly lifting the bottom edge of the protective jewelry sleeve 200 on an individual jewelry storage system 10 reveals the identification marker cuff 230 and associated identification marker of the jewelry storage system 10 below without displacing or disorganizing the storage. The hanging handle 160 may then be used for the easy removal of the identified and desired jewelry storage system 10.

Figure 5:
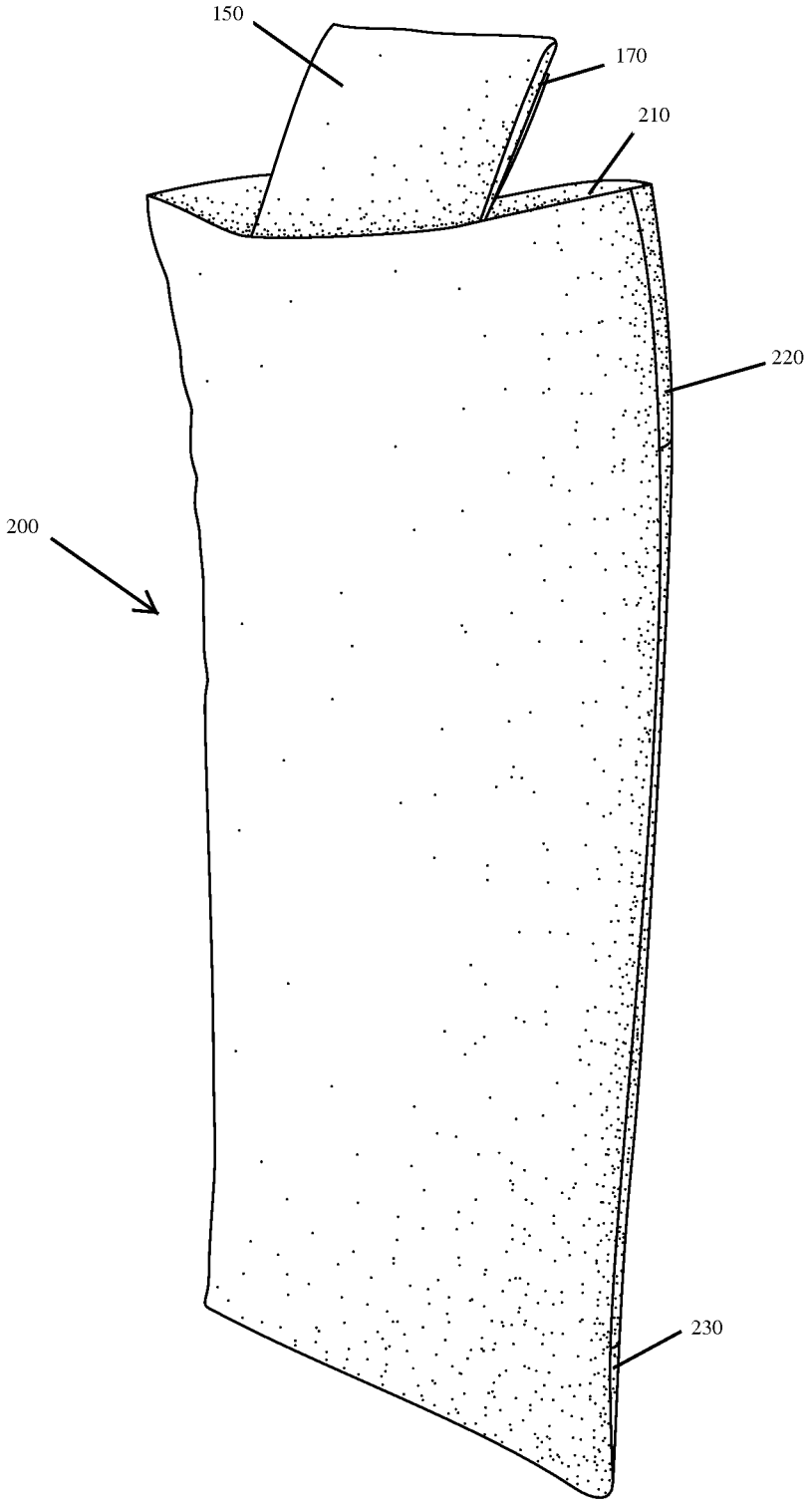
FIG. 5 is a rear perspective view of FIG. 1A with a hanging loop having a piecing surface attached thereto flipped out of the protective jewelry sleeve element according to embodiments of the present disclosure.
Figure 6:
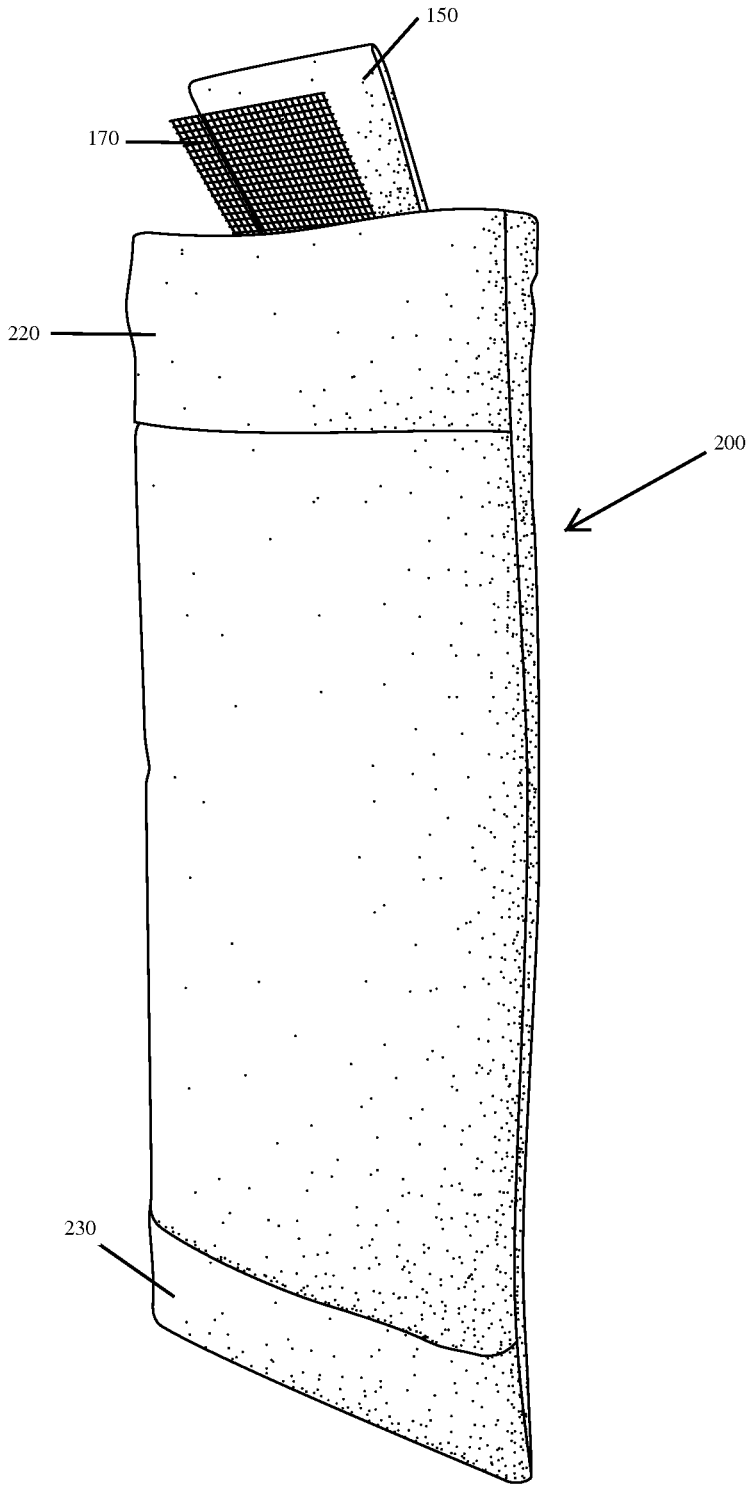
FIG. 6 is a front perspective view of FIG. 5 according to embodiments of the present disclosure.
Figure 7:
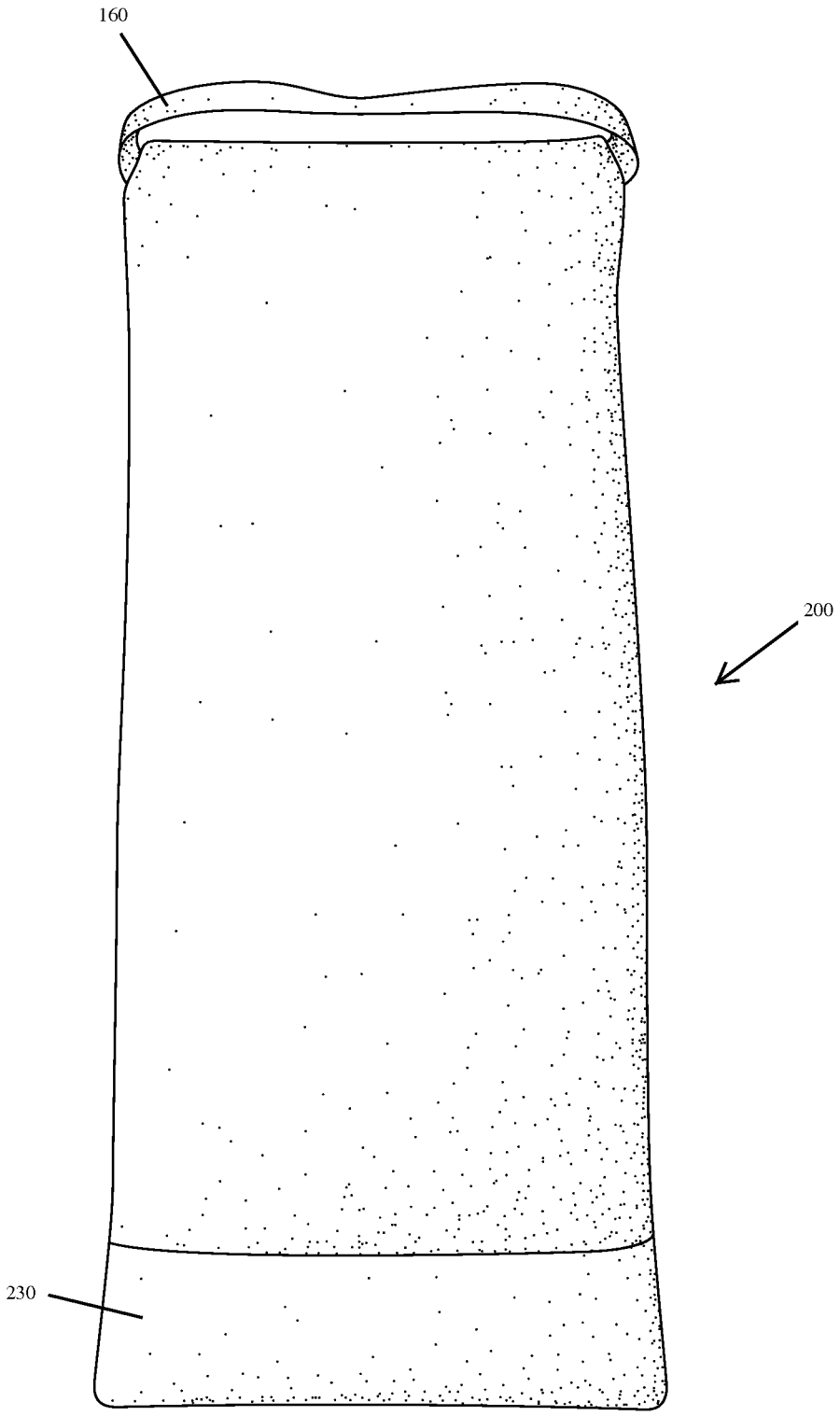
FIG. 7 is a front elevational view of the protective jewelry sleeve and display board with the display board element disposed within the protective jewelry sleeve element and the closure cuff inverted to close the protective jewelry sleeve element and reveal the hanging handle according to embodiments of the present disclosure.
Figure 8:
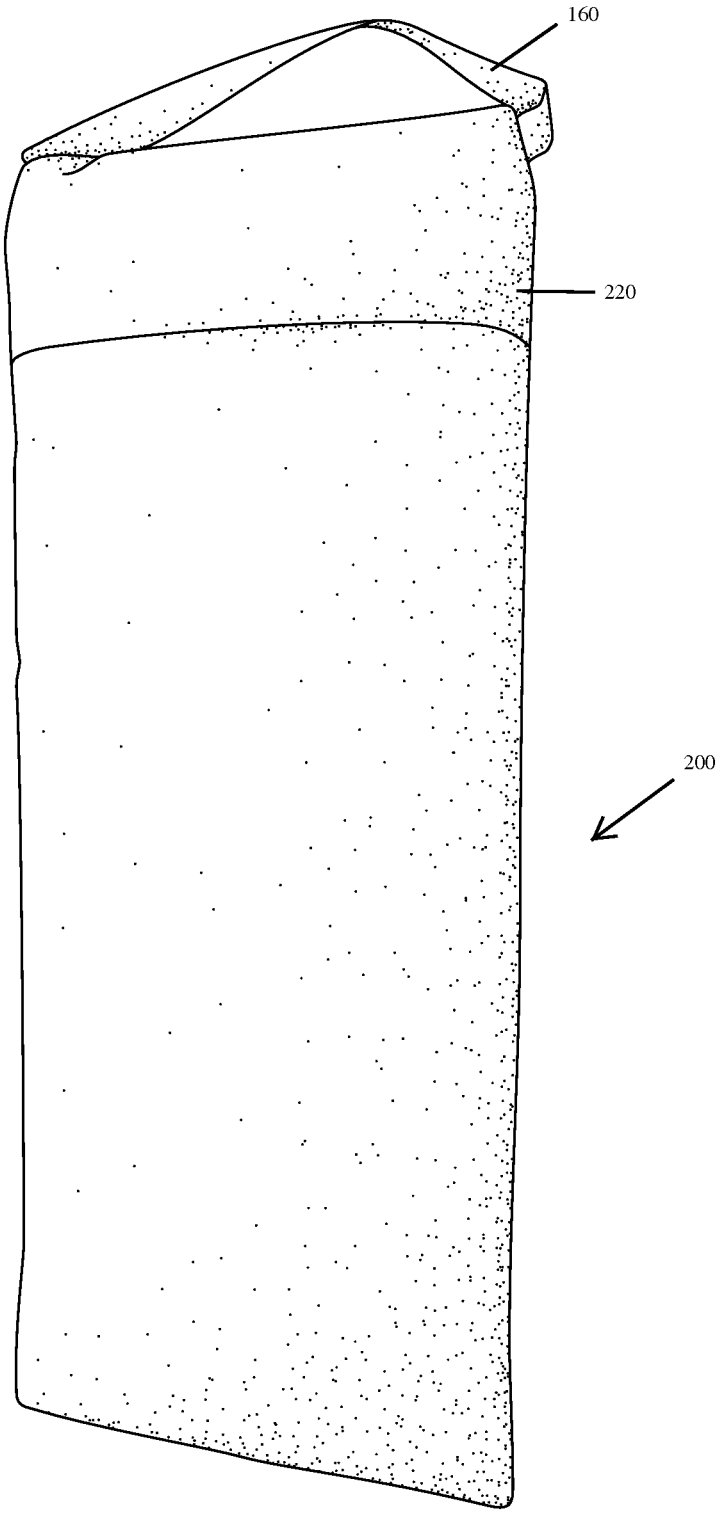
FIG. 8 is a rear elevational view of FIG. 7 according to embodiments of the present disclosure.
Figure 9:
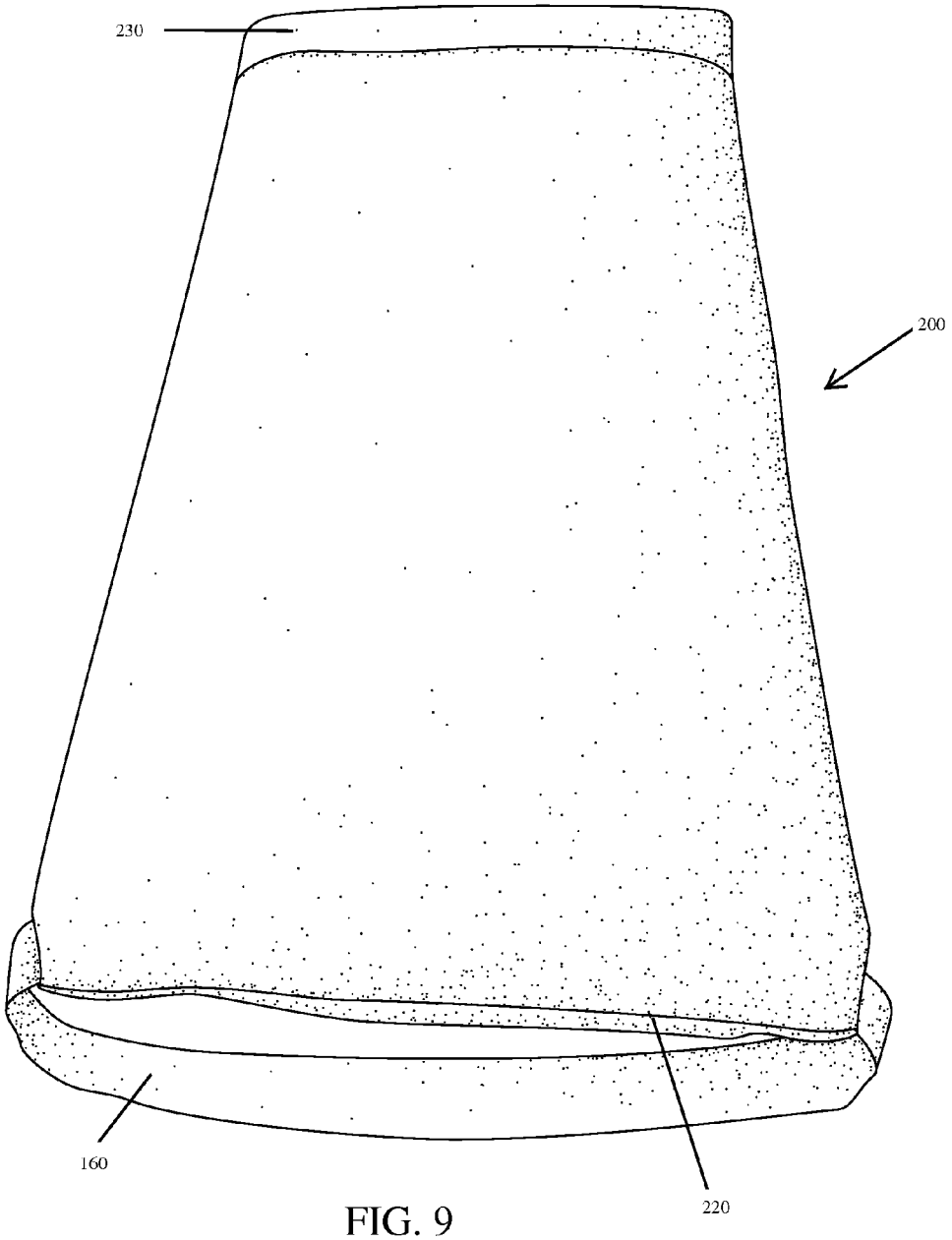
FIG. 9 is a top perspective view of FIG. 7 according to embodiments of the present disclosure.
Figure 10A:
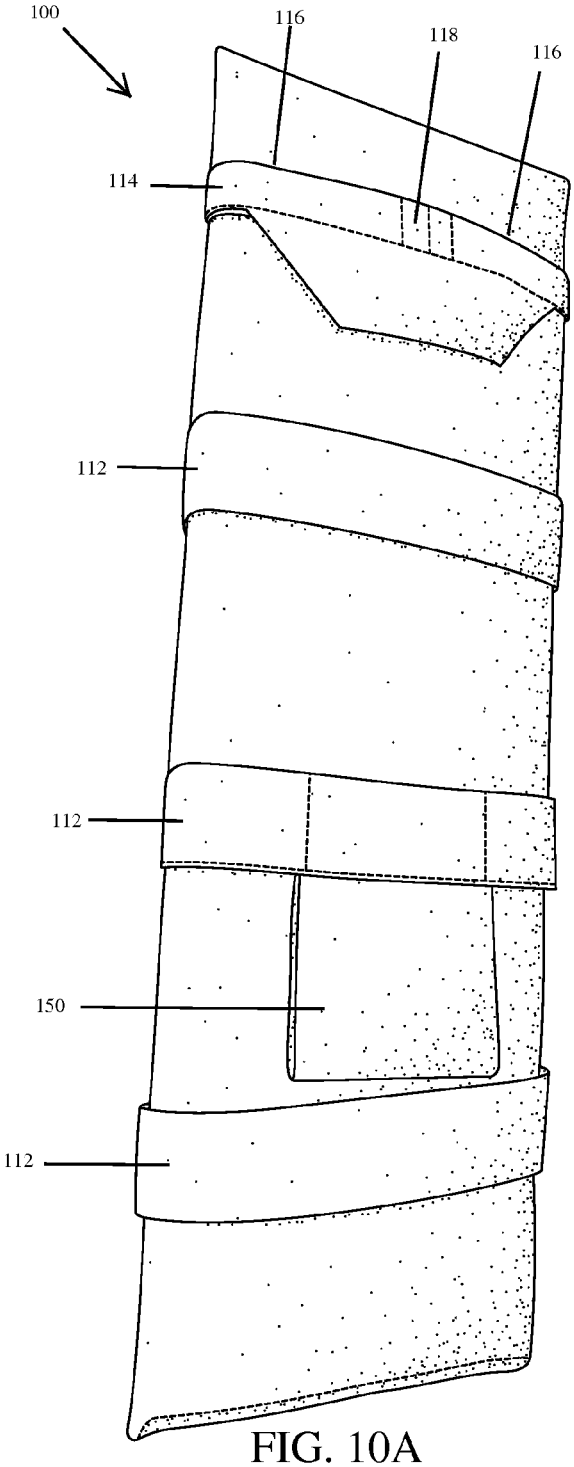
FIG. 10A is a front perspective view of a display board according to embodiments of the present disclosure.
Figure 10B:
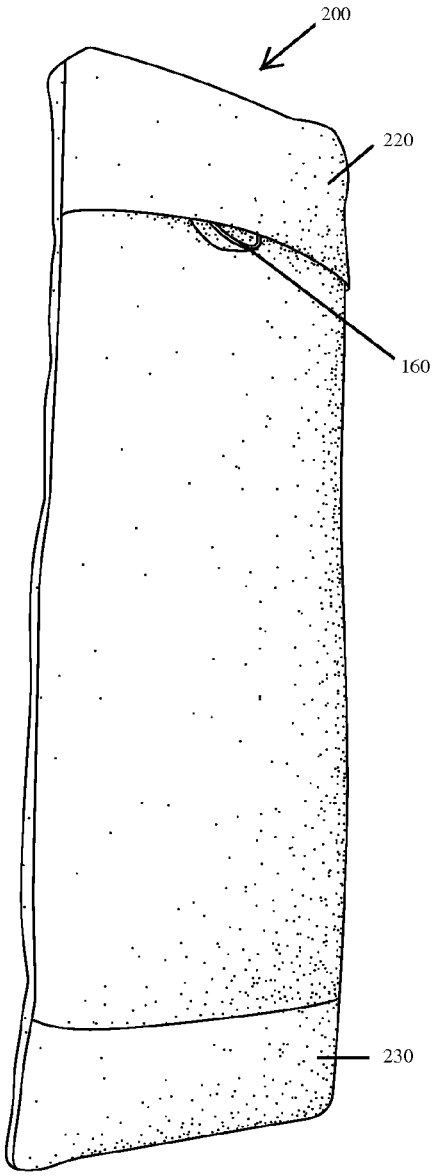
FIG. 10B is a front perspective view of a protective jewelry sleeve according to embodiments of the present disclosure.

In embodiments, the protective jewelry sleeve 200 also includes at least one hanging loop 150 affixed to an interior surface of the protective jewelry sleeve adjacent the single open end 210 as seen in FIG. 5 and FIG. 6, for example. The hanging loop 150 is formed from a loop with open ends which is configured to allow passage of jewelry through the open ends. For example a bracelet with a clasp may be passed through the hanging loop 150 and then once the clasp is engaged the hanging loop 150 retains the bracelet. In further embodiments, the hanging loop 150 is configured to reversibly open to allow passage of the open hanging loop through a piece of jewelry and subsequently be closed to retain the piece of jewelry therein. For example, a reversible closure mechanism such as a hook and loop fastener may secure the hanging loop 150 in a closed position forming a complete loop while allowing the hanging loop 150 to be temporarily opened to pass through a bangle style bracelet. Additionally, the hanging loop 150 allows a coordinating bracelet and necklace set to be stored together with the jewelry storage system 10.

The hanging loop 150 in the protective jewelry sleeve 200 also allows the protective jewelry sleeve 200 to be used without the display board 100 for the storage and transport of jewelry in a secured manner. Specifically, the movement of jewelry inside the protective jewelry sleeve 200 with the hanging loop 150 can range from minimal movement to complete restricted movement when it is being carried by the hanging handle 160. The hanging loop 150 can be pulled out with the attached jewelry to display the jewelry against the exterior surface of the protective jewelry sleeve 200 but then reinserted into the protective jewelry sleeve 200 for storage and transport with the padding 180 providing protection. The protective jewelry sleeve 200 removed from the display board 100 provides the closure cuff 220 and identification marker cuff 230 as well as separated storage of individual jewelry pieces.

The simplicity in use of the jewelry storage system 10 is as unique and ageless as it is a timely invention for updating jewelry storage relevant to the needs of today's consumers. The jewelry storage system 10 provides efficient use of time and space without sacrificing maximum protection of investment and pride in jewelry ownership. The jewelry storage system's 10 revolutionary storage application for protecting jewelry is limitless because its design is interchangeable, customizable and manufactured in various sizes to accommodate every style and length of jewelry to be secured and protected in storage while packed ready for travel and displayed by its full length and width in an unexposed storage. The storage solution provided by the jewelry storage system 10 helps eliminate damage from air exposure, impacts with other exposed jewelry or other objects as well as effectively help eliminate abrasion, dust, folding, bunching and tangling from the use of undersized boxes, drop-in bags and/or pouches.

Figure 3A:
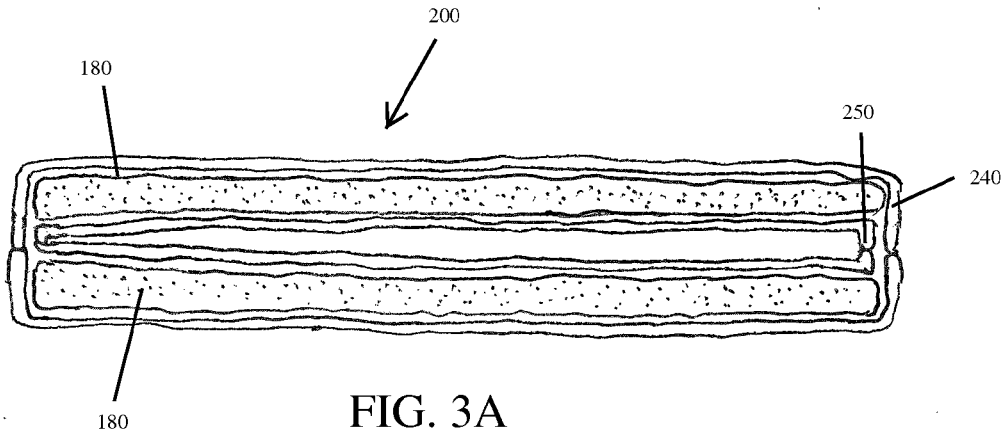
FIG. 3A is a cut view of FIG. 1A showing the layered internal structure of the protective jewelry sleeve.
Figure 3B:
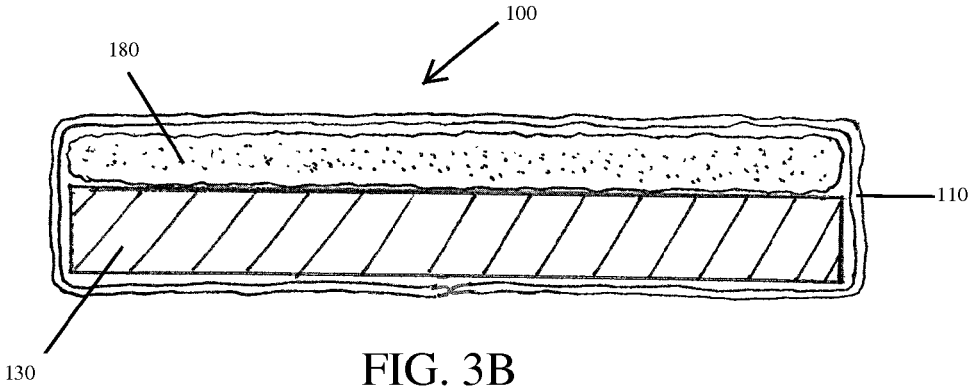
FIG. 3B is a cut view of FIG. 1B showing the layered internal structure of the display board.
Figure 4:
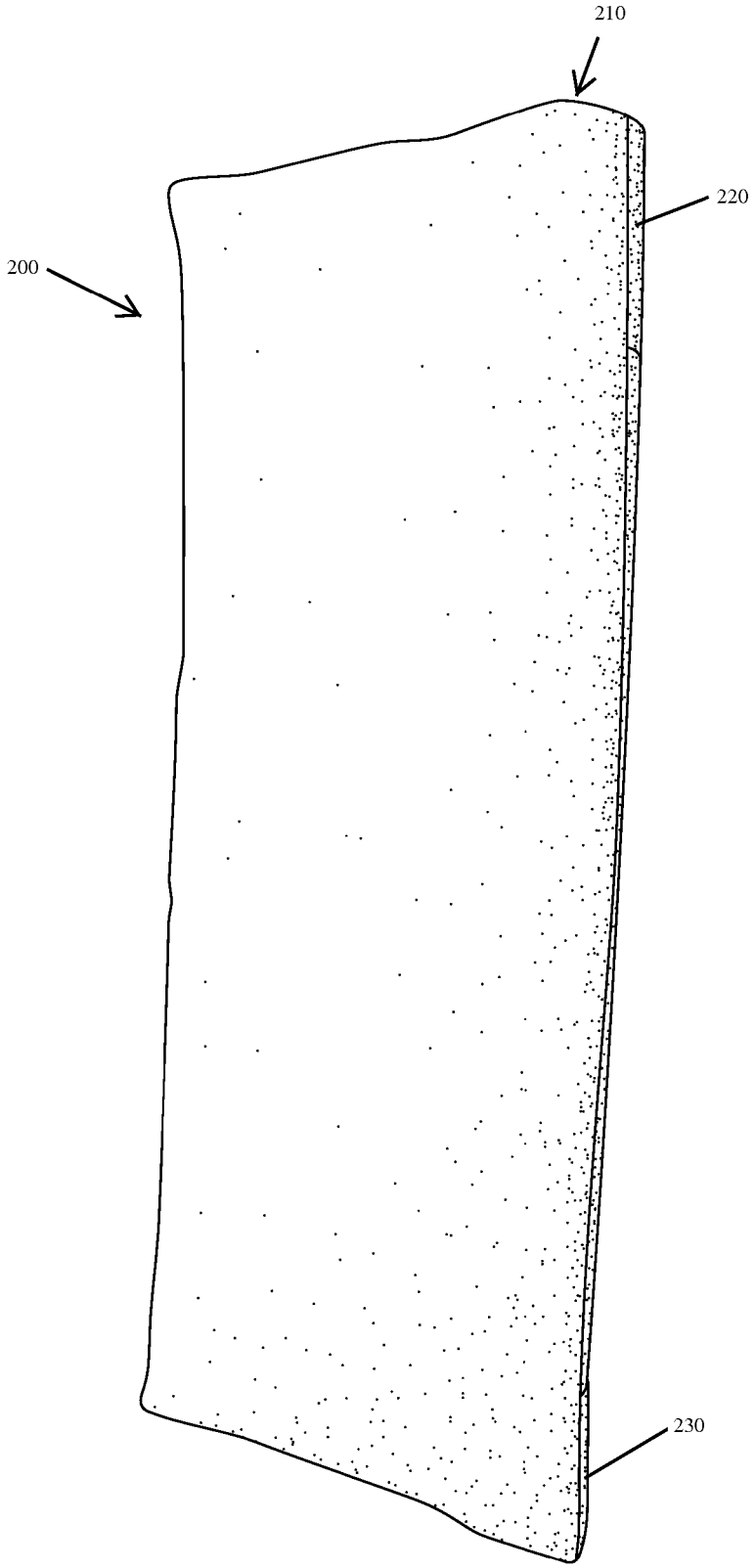
FIG. 4 is a rear perspective view of FIG. 1A according to embodiments of the present disclosure.

With reference to FIG. 3A and FIG. 3B, in embodiments, the jewelry storage system 10 is lined and padded for storing and protecting jewelry displayed and secured to the display board 100. In specific embodiments, the display board 100 is covered with the sleeve cover 110 with padding 180 disposed between the sleeve cover 110 and the rigid insert 130. The combination of a padded display board 100 and padded protective jewelry sleeve 200 creates a sandwich effect of protection. The display board 100 with attached jewelry is secured inside the protective jewelry sleeve 200 when the closure cuff 220 is flipped over the sleeve opening 210 for a secure closure. The closure cuff 220 is stitched to the protective jewelry sleeve 200 and may be flipped on the protective jewelry sleeve 200 front-to-back or back-to-front to create a secure cuff-capped closure in addition to revealing the hanging handle 160.

With reference to FIG. 6, in multiple embodiments, the piercing surface 170 of netting, lace, mesh, or any coordinating material can be attached to the protective jewelry sleeve 200. Specifically, the piercing surface 170 may be affixed to the interior of the protective jewelry sleeve 200 adjacent the hanging loop 150, for example. In specific embodiments, the piercing surface 170 may comprise a mesh with holes sized and configured for attachment of earrings thereto by passage of the posts or hooks of the earrings through the holes in the piercing surface 170.

In embodiments, the back bottom edge of the display board 100 has two miscellaneous storage pockets 140 created by the band forming the storage pocket 140 on the front of the display board 100 wrapping around. The storage pockets 140 on both the front and back side of the display board 100 provide a storage solution for rings, tie bars, cuff links, or other miscellaneous jewelry. Additionally, in embodiments the upper back side of the display board 100 has two additional open slots 116 created by the extended ends of the band forming the clasp loop 114 extending across the sleeve cover 110 back-side with the raw ends stitched into the back center seam. The additional open slots 116 can be used to hang the display board 100. Hanging the display board 100 by the two additional open slots 116 insures a consistent balanced hanging display.

In embodiments the jewelry storage system 10 is made of a variety of sewing materials of assorted colors and patterns in a range of standard whole and half sizes. Non-limiting examples include a jewelry storage system 10 with the protective jewelry sleeve 200 manufactured approximately 3 to 6 inches wide by approximately 4 to 26 inches long and the display board 100 manufactured approximately 2 to 4½ inches wide by approximately 4 to 24 inches long. As such, the protective jewelry sleeve 200 is finished 1 or more inches longer and 1 or more inches wider than the display board 100. Further, it is contemplated that the jewelry storage system 10 may be manufactured in any length and width dimensions to match a consumer's customized unique size requirements or specialized jewelry.

Exemplary manufacturing instructions are provided to describe in detail an exact method of forming and assembling an embodiment of the protective jewelry sleeve 200 of the jewelry storage system 10. One skilled in the art would recognize that modifications may be made from the described method without deviating from the spirit of the disclosure. The protective jewelry sleeve 200 is formed from a protective jewelry sleeve shell 240 and protective jewelry sleeve lining 250. The protective jewelry sleeve shell 240 is made with two identical rectangle fabric panels cut double the finished width plus two inches and the finished length plus two inches with center markings to indicate the front and back. The protective jewelry sleeve 200 closes with a closure cuff 220 made with a cut of material 3 to 5 inches long by the width of the sleeve front or back and folded in half with the non-finished sides together. The hanging handle 160 is a ½ inch wide ribbon or a ½ inch wide finished band made from same or similar material as the protective jewelry sleeve 200. The finished hanging handle 160 is cut 1-inch longer than the width of the closure cuff 220. The hanging handle 160 is stitched to the right side of the protective jewelry sleeve 200 front or back, at the center of the front and back panel and at the side raw edge. The folded closure cuff 220 is placed over the hanging handle 160 with top and side raw edges even and at front and back panel center; keeping the hanging handle 160 free of top edges, the closure cuff 220 is stitched to the back or front top edge, panel center, and the raw side edge. The fabric for the identification marker cuff 230 is cut 3 to 4 inches long by the width of the protective jewelry sleeve 200 bottom front and is folded in half lengthwise. The identification marker cuff 230 bottom raw edge is stitched to the protective jewelry sleeve 200 bottom front edge and the side edges are stitched to the front and back panel center and to the back side raw edge to form the 1½ to 2-inch deep Identification marker cuff 230. Padding 180 formed from a protective layer of approximately ¼ to ½ inch batting or foam is attached to the non-finished side of the front. The protective jewelry sleeve 200 is fully lined with the protective jewelry sleeve lining 250 using an identical measured cut front and back panel as the protective jewelry sleeve shell 240 front and back panel. The protective jewelry sleeve lining 250 front and back panel is cut from the protective jewelry sleeve shell 240 material or a coordinating material. With finished sides together, the protective jewelry sleeve lining 250 front and back panel is stitched to the top edge of the protective jewelry sleeve shell 240 front and back panel. The protective jewelry sleeve 200 with the protective jewelry sleeve lining 250 is opened out and folded in half lengthwise with finished sides together and stitched the length of the raw side edge, folded side edge and the bottom edge. The protective jewelry sleeve 200 is turned right side out with the protective jewelry sleeve lining 250 extending from top edge of the protective jewelry sleeve shell 240. The protective jewelry sleeve lining 250 bottom front and back edges are stitched together with non-finished sides together. The protective jewelry sleeve lining 250 is inserted inside the protective jewelry sleeve 200 completing the assembly of the protective jewelry sleeve shell 240. The attached closure cuff 220 will flip over the finished protective jewelry sleeve opening 210 creating a cuff-cap closure revealing the hanging handle 160 used for easy slide removal of the filled protective jewelry sleeve 200 from stacked storage, for carrying or for hanging. The identification marker cuff 230 is configured to hold a readily identifiable ID card, photo, or other identification marker extending above the identification marker cuff 230. A plurality of the jewelry storage systems 10 can be stacked in sequence of decreasing length to allow each identification marker to always be visible. Further, jewelry storage systems 10 of the same length may also be stacked allowing for quick and easy review of the identification marker in each identification marker cuff 230 by flipping through the stack.

Exemplary manufacturing instructions are provided to describe in detail an exact method of forming and assembling an embodiment of the display board 100 of the jewelry storage system 10. One skilled in the art would recognize that modifications may be made from the described method without deviating from the spirit of the disclosure. A board material panel for the sleeve cover 110 is cut double the width of the display board 100 plus 2 inches and the length is cut the length of the display board 100 plus 3-inches. Construction of the board material panel can be sewn with two side seams or it can be constructed with a single center-back-seam. For the single center-back seam, the display board sleeve-cover material panel is marked at center to determine the center front of the sleeve cover. The raw edges of the material panel are each placed ½-inch overlap of the center-front marking to mark sides of the sleeve cover. The bottom edge of the board material panel has ½ inch pressed to the non-finished side of the fabric and edge-stitched together after inserting the rigid insert 130. The clasp loop 114 and securing bands 112 are cut from a finished band-strip of like-material made from a strip of fabric cut 2 to 3 inches wide. The securing bands 112 are cut double the display board 100 width plus 2-inches. The securing bands 112 are attached to one side raw edge with the first securing band 112 attached two inches below the clasp loop 114 and at 3 to 4 inch intervals between each securing band 112, ending with a two to three inch wide band cut the width of the cover-sleeve panel and stitched in-place at the board's side and bottom raw edges to form the storage pocket 140. The band for the clasp loops 114 is cut the width of the sleeve cover 110 fabric panel plus 1 inch. To form the clasp loop 114 band strip, the fabric strip side edges are pressed to the center of the strip and the folded edges are pressed together and edged-stitched or the strip can be stitched with right-side edges together, turned and pressed. The clasp loop 114 band is placed 2 inches below the top edge on the right side of the fabric front and back panel. The clasp loop band center bridge 118 and raw edges are stitched to the raw edges and at the center of the board cover-panel with the one-inch excess clasp band length pinned to the cover-sleeve front. The center of the front clasp loop 114 band is stitched to the sleeve center front marking. The clasp loop 114 band is stitched flat at center by a line of stitching ½ to 1-inch from both sides of the center front, forming the open slots 116 with a center bridge 118. The lines of stitching on each side of the center-stitched line of the clasp loop create the two narrow open slots 116 for use in inserting earrings wire for hanging earrings for display. The three lines of stitching form the center bridge 118 for separating the sides of jewelry. With ½-inch ease for each clasp loop 114, stitch a straight line of stitching through the clasp loop 114 strip at cover panel side markings. A layer of padding 180 is attached to the length and width of the sleeve cover 110 front. The sleeve cover 110 raw edges are stitched together forming a center back seam and stitched together at top edges. The sleeve cover 110 is turned right side out. The rigid insert 130 is cut 2-inch shorter than the finished sleeve cover 110 and inserted from bottom-up. The bottom edges are edged stitched together to finish the display board 100. Alternatively a reversible closure such as a zipper or hook and loop fasteners may be used to seal the bottom edge and secure the rigid insert 130 in the sleeve cover 110.

It should be noted that terms indicating a direction or geometrical relation, such as "upper" or "lower", generally refer to the corresponding drawings and are meant to aid uthe understanding, but do not imply any specific spatial orientation of the jewelry storage system during use.

What is claimed is:

1. A jewelry storage system, the jewelry storage system comprising a protective jewelry sleeve and a display board;

the display board comprising a rigid insert disposed inside a sleeve cover, the sleeve cover comprising:

at least one securing band wrapped fully around the sleeve cover, and at least one clasp loop forming at least two open slots with a center bridge formed therebetween; and the rigid insert comprising a rigid panel sized to fit snuggly into the sleeve cover and provide rigidity to the display board; and the protective jewelry sleeve forming a sleeve with a single open end and sized to dispose the display board therein, wherein the sleeve comprises a closure cuff disposed proximal the open end and an identification marker cuff disposed distal the open end, the closure cuff comprising an invertible cuff configured to flip over the open end of the protective jewelry sleeve and cover the open end of the protective jewelry sleeve; and the identification marker cuff comprising a cuffed pocket configured to hold an identification marker with indicia of the contents of the jewelry storage system.

2. The jewelry storage system of claim 1, wherein the sleeve cover further comprises at least one hanging loop affixed to one of the securing bands, the hanging loop comprising a loop with open ends configured to allow passage of jewelry through the open ends and retention therein.

3. The jewelry storage system of claim 2, wherein the hanging loop is configured to reversibly open to allow passage of the open hanging loop through a piece of jewelry and subsequently be closed to retain the piece of jewelry therein.

4. The jewelry storage system of claim 1, wherein the sleeve cover further comprises a piercing surface comprising a mesh disposed adjacent the at least one clasp loop, the piercing surface sized and configured for attachment of earrings thereto by passage of the posts or hooks of said earrings through the holes in the piercing surface.

5. The jewelry storage system of claim 1, wherein the sleeve cover comprises at least three securing bands.

6. The jewelry storage system of claim 1, wherein the at least one securing band is affixed to the sleeve cover at only one end and comprises a reversible closure mechanism to reversibly affix the opposite end of the at least one securing band to the sleeve cover.

7. The jewelry storage system of claim 6, wherein the reversible closure mechanism of the at least one securing band is a hook and loop fastener, a snap, a clip, a ribbon configured for tying, or a hook and eye closure.

8. The jewelry storage system of claim 1, wherein the at least one securing band is affixed at both ends and comprises elastic to allow reversible stretching of the at least one securing band.

9. The jewelry storage system of claim 1, wherein the display board comprises padding disposed between the rigid insert and the sleeve cover.

10. The jewelry storage system of claim 1, wherein the sleeve cover extends beyond the rigid insert to form a cushioned region configured to allow perforation therethrough for securing of jewelry comprising a sharp stud or pin thereto.

11. The jewelry storage system of claim 1, wherein the sleeve cover comprises a reversible closure configured to allow the rigid insert to be reversibly removed from the sleeve cover and reinserted therein.

12. The jewelry storage system of claim 1, wherein the sleeve cover further comprises a storage pocket disposed distal the at least one clasp loop.

13. The jewelry storage system of claim 1, wherein the protective jewelry sleeve further comprises a hanging handle revealed when the closure cuff is flipped over the open end of the protective jewelry sleeve to cover the open end of the protective jewelry sleeve.

14. The jewelry storage system of claim 1, wherein the protective jewelry sleeve further comprises at least one hanging loop affixed to an interior of the protective jewelry sleeve adjacent the single open end, the hanging loop comprising a loop with open ends configured to allow passage of jewelry through the open ends and retention therein.

15. The jewelry storage system of claim 14, wherein the hanging loop is configured to reversibly open to allow passage of the open hanging loop through a piece of jewelry and subsequently be closed to retain the piece of jewelry therein.

16. The jewelry storage system of claim 1, wherein the protective jewelry sleeve further comprises a piercing surface comprising a mesh disposed adjacent the hanging loop, the piercing surface sized and configured for attachment of earrings thereto by passage of the posts or hooks of said earrings through the holes in the piercing surface.

17. The jewelry storage system of claim 1, wherein the protective jewelry sleeve comprises a protective jewelry sleeve shell and a protective jewelry sleeve lining with padding disposed therebetween on a single side of the protective jewelry sleeve.

18. The jewelry storage system of claim 1, wherein the protective jewelry sleeve comprises a protective jewelry sleeve shell and a protective jewelry sleeve lining with padding disposed therebetween on both a front and a back side of the protective jewelry sleeve.

19. A jewelry storage system, the jewelry storage system comprising a protective jewelry sleeve and a display board;

the display board comprising a rigid insert disposed inside a sleeve cover, the sleeve cover comprising:

at least three securing bands wrapped fully around the sleeve cover and affixed to the sleeve cover at only one end comprising a reversible closure mechanism to reversibly affix the opposite end of the at least three securing bands to the sleeve cover, at least one clasp loop forming at least two open slots with a center bridge formed therebetween, at least one hanging loop affixed to one of the securing bands, the hanging loop comprising a loop with open ends configured to allow passage of jewelry through the open ends and retention therein, and a piercing surface comprising a mesh disposed adjacent the at least one clasp loop, the piercing surface sized and configured for attachment of earrings thereto by passage of the posts or hooks of said earrings through the holes in the piercing surface; and the rigid insert comprising a rigid panel sized to fit snuggly into the sleeve cover and provide rigidity to the display board; and the protective jewelry sleeve forming a sleeve with a single open end and sized to dispose the display board therein, wherein the sleeve comprises;

a protective jewelry sleeve shell forming an exterior surface of the protective jewelry sleeve, a protective jewelry sleeve lining forming an interior of the protective jewelry sleeve, a closure cuff disposed proximal the open end, and an identification marker cuff disposed distal the open end, the closure cuff comprising an invertible cuff configured to flip over the open end of the protective jewelry sleeve and cover the open end of the protective jewelry sleeve; and the identification marker cuff comprising a cuffed pocket configured to hold an identification marker with indicia of the contents of the jewelry storage system, and a hanging handle disposed proximal the single open end and revealed when the closure cuff is flipped over the open end of the protective jewelry sleeve to cover the open end of the protective jewelry sleeve;

wherein the display board comprises padding disposed between the rigid insert and the sleeve cover and the protective jewelry sleeve comprises padding disposed between the protective jewelry sleeve shell and the protective jewelry sleeve lining.

20. A jewelry storage system, the jewelry storage system comprising a protective jewelry sleeve and a display board;

the display board comprising a rigid insert disposed inside a sleeve cover, the sleeve cover comprising:

at least three securing bands wrapped fully around the sleeve cover and affixed to the sleeve cover at only one end comprising a reversible closure mechanism selected from a hook and loop fastener, a snap, a clip, a ribbon configured for tying, and a hook and eye closure to reversibly affix the opposite end of the at least three securing bands to the sleeve cover, at least one clasp loop forming at least two open slots with a center bridge formed therebetween, at least one hanging loop affixed to one of the securing bands, the hanging loop comprising a loop with open ends configured to allow passage of jewelry through the open ends and retention therein, a storage pocket disposed distal the at least one clasp loop, a piercing surface comprising a mesh disposed adjacent the at least one clasp loop, the piercing surface sized and configured for attachment of earrings thereto by passage of the posts or hooks of said earrings through the holes in the piercing surface, and a reversible closure configured to allow the rigid insert to be reversibly removed from the sleeve cover and reinserted therein; and the rigid insert comprising a rigid panel sized to fit snuggly into the sleeve cover and provide rigidity to the display board; and the protective jewelry sleeve forming a sleeve with a single open end and sized to dispose the display board therein, wherein the sleeve comprises;

a protective jewelry sleeve shell forming an exterior surface of the protective jewelry sleeve, a protective jewelry sleeve lining forming an interior of the protective jewelry sleeve, a closure cuff disposed proximal the open end, and an identification marker cuff disposed distal the open end, the closure cuff comprising an invertible cuff configured to flip over the open end of the protective jewelry sleeve and cover the open end of the protective jewelry sleeve; and the identification marker cuff comprising a cuffed pocket configured to hold an identification marker with indicia of the contents of the jewelry storage system a hanging handle disposed proximal the single open end and revealed when the closure cuff is flipped over the open end of the protective jewelry sleeve to cover the open end of the protective jewelry sleeve, at least one hanging loop affixed to an interior of the protective jewelry sleeve adjacent the single open end, the hanging loop comprising a loop with open ends configured to allow passage of jewelry through the open ends and retention therein, and a piercing surface comprising a mesh disposed adjacent the hanging loop, the piercing surface sized and configured for attachment of earrings thereto by passage of the posts or hooks of said earrings through the holes in the piercing surface;

wherein the display board comprises padding disposed between the rigid insert and the sleeve cover and the protective jewelry sleeve comprises padding disposed between the protective jewelry sleeve shell and the protective jewelry sleeve lining on both a front and a back side of the protective jewelry sleeve, and wherein the sleeve cover extends beyond the rigid insert to form a cushioned region configured to allow perforation therethrough for securing of jewelry comprising a sharp stud or pin thereto.

* * * * *